US012110673B2

(12) United States Patent
Jackman et al.

(10) Patent No.: US 12,110,673 B2
(45) Date of Patent: Oct. 8, 2024

(54) TELESCOPING TOILET MOUNTING FLANGE

(71) Applicants: John D. Jackman, Framingham, MA (US); Christopher M. Jackman, Framingham, MA (US); Brian F. Jackman, Worcester, MA (US)

(72) Inventors: John D. Jackman, Framingham, MA (US); Christopher M. Jackman, Framingham, MA (US); Brian F. Jackman, Worcester, MA (US)

( * ) Notice: Subject to any disclaimer, the term of this patent is extended or adjusted under 35 U.S.C. 154(b) by 283 days.

(21) Appl. No.: 17/863,058

(22) Filed: Jul. 12, 2022

(65) Prior Publication Data

US 2022/0341147 A1 Oct. 27, 2022

Related U.S. Application Data

(63) Continuation-in-part of application No. 17/165,672, filed on Feb. 2, 2021, now Pat. No. 11,391,030, which is a continuation-in-part of application No. 14/982,765, filed on Dec. 29, 2015, now Pat. No. 10,907,335.

(60) Provisional application No. 62/097,357, filed on Dec. 29, 2014.

(51) Int. Cl.
*E03D 11/16* (2006.01)

(52) U.S. Cl.
CPC ..... *E03D 11/16* (2013.01)

(58) Field of Classification Search
CPC ..... E03D 11/14; E03D 11/16–17
See application file for complete search history.

(56) References Cited

U.S. PATENT DOCUMENTS

| | | | | |
|---|---|---|---|---|
| 827,230 | A | 7/1906 | Goeppinger | |
| 1,206,580 | A | 11/1916 | O'Leary | |
| 2,837,750 | A | 6/1958 | Robinson | |
| 3,400,411 | A | 9/1968 | Harvey | |
| 3,501,172 | A | 3/1970 | Pickard | |
| 4,515,398 | A | 5/1985 | Machon, Sr. | |
| 5,185,890 | A | 2/1993 | Dismore et al. | |
| 5,421,036 | A * | 6/1995 | Stevens | E03D 11/16 285/60 |
| 5,608,922 | A | 3/1997 | Lewis | |

(Continued)

*Primary Examiner* — David P Angwin
*Assistant Examiner* — Nicholas A Ros
(74) *Attorney, Agent, or Firm* — Thomas P. O'Connell; O'Connell Law Firm

(57) ABSTRACT

A telescoping toilet mounting assembly and a method for mounting a toilet to a floor and a wastewater pipe. Hollow bolts project from clamping plates to be received through mounting holes in an upper male flange section and through mounting holes of a toilet base. Base bolt nuts are tightened onto the hollow bolts to secure the upper male flange section to the toilet base prior to lowering the toilet and the upper male flange section into engagement with a lower female flange section. Fastening bolt structures with adjustable-length body portions and threaded tips can pass through the hollow bolts and into threaded engagement with mounting members fixed to the lower female flange section fixed to the wastewater pipe and the floor. Alternatively, fastening bolts pass through the hollow bolts and into threaded engagement with upstanding registration and locking rods retained relative to the lower female flange section.

27 Claims, 18 Drawing Sheets

(56) References Cited

U.S. PATENT DOCUMENTS

| | | | | |
|---|---|---|---|---|
| 5,862,533 | A | 1/1999 | Johnson et al. | |
| 6,065,160 | A | 5/2000 | Winn | |
| 6,254,141 | B1 * | 7/2001 | Piper | E03D 11/16 285/58 |
| 6,367,093 | B1 | 4/2002 | Hawro | |
| 6,438,765 | B1 | 8/2002 | Johnson et al. | |
| 6,519,784 | B2 | 2/2003 | Carwile | |
| 6,598,241 | B1 | 7/2003 | Williams | |
| 6,615,413 | B1 | 9/2003 | Grant et al. | |
| 6,719,294 | B2 | 4/2004 | Nguyen et al. | |
| 6,745,408 | B2 | 6/2004 | Spells, Sr. | |
| 7,069,603 | B2 | 7/2006 | Flushing | |
| 8,281,421 | B2 * | 10/2012 | Hughes | E03D 11/16 4/252.5 |
| 9,051,723 | B2 * | 6/2015 | Junca | E03D 11/16 |
| 9,169,629 | B2 | 10/2015 | Jensen et al. | |
| 9,556,603 | B2 | 1/2017 | Guthrie | |
| 9,909,296 | B2 * | 3/2018 | Schuster | F16B 5/0233 |
| 2010/0123307 | A1 | 5/2010 | Coronado | |
| 2012/0240319 | A1 | 9/2012 | Yssel | |

* cited by examiner

TELESCOPING TOILET MOUNTING FLANGE

RELATED APPLICATIONS

This application is a continuation-in-part of U.S. patent application Ser. No. 17/165,672, filed Feb. 2, 2021, which is a continuation-in-part of U.S. patent application Ser. No. 14/982,765, filed Dec. 29, 2015, now U.S. Pat. No. 10,907,335, which claims priority to U.S. Provisional Application No. 62/097,357, filed Dec. 29, 2014, all of which being incorporated herein by reference.

FIELD OF THE INVENTION

The present invention relates generally to systems and methods for mounting toilets in relation to wastewater pipes and floor structures. More particularly, disclosed herein is a telescoping mounting system and a method for mounting toilets using such a system in a rapid, efficient, and reliably watertight manner.

BACKGROUND OF THE INVENTION

Closet flanges of varied designs are well known in the plumbing industry. In residential use, many modern closet flanges are constructed of polyvinyl chloride (PVC) plastic or metal or PVC and metal with a rigid outer ring. Such closet flanges have apertures in the outer ring to facilitate attachment of the flange to a floor structure. Slots are disposed in the flange to allow the fitting of anchor bolts that project, typically in a precarious manner, from the slots in the flange to engage mounting holes in a toilet base. Inside the outer ring is a lower toroidal or donut-shaped section where a wax ring forms a seal around the discharge horn that projects from the bottom of the toilet. A lower pipe-shaped portion attaches to a waste pipe beneath the floor level.

Closet flanges are designed to be installed on top of the finished floor to maintain the proximity of the toilet horn and the lowered portion of the flange at the intended spacing for a standard wax ring to fill. For many, many years, such wax rings have been the accepted method for creating a seal between the toilet and the closet flange. To install a toilet with such a wax ring seal, a person typically must first set the toilet on its back or side and press the wax ring firmly on to the area around the toilet horn on the bottom of the toilet.

In further preparation for setting the toilet, a person must cause two anchor bolts to project vertically through the slots in the closet flange. Plumbers often use some of the wax ring in an ad hoc manner to attempt to stabilize the anchor bolts. Some types of anchor bolts include a pair of plastic retainers to seek to hold the bolts upright. Even with these proposed solutions, the ability of the anchor bolts to be retained in a substantially vertical position during installation is tenuous at best.

To set the toilet in place, the installer, who often has a limited ability to perceive the anchor bolts around the toilet, must attempt to hold the heavy toilet just above the closet flange in exactly the right location and orientation so that the anchor bolts align with the mounting holes of the toilet and then lower the toilet carefully to cause both anchor bolts to pass through the mounting holes in the toilet base simultaneously. If the anchor bolts miss the mounting holes in the toilet base, the anchor bolts will likely be displaced laterally, perhaps while being fouled by being inadvertently driven into the wax ring. The toilet must then be removed and set on its side or back and the anchor bolts must be realigned to prepare for another try. Once the toilet is successfully lowered to cause the anchor bolts to be received through the mounting holes, the toilet is pressed into place and nuts are tightened onto the anchor bolts to fix the toilet in place. Since toilet bases vary in thickness, most anchor bolts are made longer than typically necessary. Consequently, any excess must be cut away if one is to allow for proper fitting of a plastic modesty cap.

In addition to the challenges inherent in such installation structures and methods, the experienced installer will be aware that, when a toilet is applied over raised flooring material, such as tile, applied under its base or where the floor structure is unsound or not level, the spacing that the wax ring must span and seal can be increased beyond the capacity of the ring. Proper sealing is thus prevented. Furthermore, wax rings are inherently messy and are known to leak, such as where they are not disposed in the intended location, where they detach unnoticed, where a portion of or even the entire ring is forced out of the flange laterally, or where the wax ring is not thick enough to fill in the intended area. Still further, it has been found that heated floors can cause the wax to liquefy and weep out from under the toilet base.

With the limitations and challenges exhibited by prior art toilet installation methods well-recognized, there has been a longstanding need for a toilet mounting system and a method for installing such systems that facilitates the mounting of toilets in relation to floor structures in a rapid, efficient, and reliably watertight manner.

SUMMARY OF THE INVENTION

In view of the foregoing, the present invention is founded on the basic object of providing a toilet mounting system and a method for mounting toilets that facilitates the mounting of toilets in relation to floor structures rapidly, efficiently, and in a reliably watertight manner.

A further object of embodiments of the invention is to eliminate the need for messy and unreliable wax rings during toilet installation.

A more particular object of the toilet mounting system and method disclosed herein is to eliminate the need for cumbersome attempts to lower a toilet onto precariously upstanding mounting bolts during toilet installation.

These and further objects, advantages, and details of the present invention will become obvious not only to one who reviews the present specification and drawings but also to those who have an opportunity to make use of an embodiment of the telescoping toilet mounting flange and method for installing toilets using such flanges disclosed herein. Although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth the foregoing objects, embodiments of the telescoping toilet mounting assembly are operable to connect a toilet with a toilet base with first and second spaced mounting holes and a wastewater discharge port to a floor, a wastewater pipe, and a lower female flange section that has a ring portion and a tubular wall portion. The toilet mounting assembly, which can alternatively be referred to and provided as a toilet mounting kit, has an upper male flange section for being mounted concentric with the wastewater discharge port of the toilet base. The upper male flange section has a ring with first and second spaced mounting holes for aligning with the first and second mounting holes of the toilet base and a tubular wall portion to be received into the lower female flange section. First and second hollow bolts are provided for being respectively received through the first and second mounting holes of the upper male flange section and through the first and second mounting holes of the toilet base. The first and second hollow bolts have exterior threads and broadened head portions. First and second base bolt nuts are provided for being tightened on to the exterior threads of the first and second hollow bolts respectively. First and second fastening bolt structures are included, each fastening bolt structure with a bolt head, a threaded tip, and a body portion that is adjustable in length from the bolt head to the threaded tip, and first and second mounting members are provided for being fixed to the lower female flange section.

Under such constructions, the upper male flange section can be attached to the toilet base by passing the first and second hollow bolts through the first and second mounting holes of the upper male flange section and through the first and second mounting holes of the toilet base. The first and second base bolt nuts can be tightened onto the first and second hollow bolts, and the toilet base and the upper male flange section so coupled can be attached to the lower female flange section and the wastewater pipe by passing the first and second fastening bolt structures through the first and second hollow bolts and into threaded engagement with the first and second mounting members when the first and second mounting members are fixed to the lower female flange section.

As disclosed herein, the fastening bolt structure can comprise a barrel bolt with an internally threaded barrel sleeve and a screw threadedly received into the barrel sleeve. A threaded locking aperture can be disposed in each mounting member, and each barrel sleeve can terminate in the threaded tip for threadedly engaging the threaded locking aperture of the mounting member.

Also according to embodiments of the invention, the broadened head portion of each of the first and second hollow bolts can comprise a clamping plate, such as an arcuate clamping plate, with the hollow bolt fixed to project from the clamping plate. Under such constructions, arcuate furrows can be disposed in an underside of the ring of the upper male flange section for receiving the clamping plates.

An annular sealant ring can be disposed between the upper male flange section and the toilet base to establish a watertight connection therebetween. Moreover, a sealant ring can be provided for being interposed between the tubular wall portions of the upper male flange section and the lower female flange section to establish a watertight connection therebetween.

According to practices of the invention, each mounting member can comprise a mounting plate with a threaded locking aperture. The mounting plates can be arcuate, and the lower female flange section can have arcuate furrows in its ring portion for receiving one of the arcuate mounting plates. It is further taught herein to have first and second mounting apertures disposed through the mounting plate spaced from the locking aperture and aligned mounting apertures disposed through the ring portion of the lower female flange section so that mounting fasteners can be passed through the mounting apertures and into a flooring material.

Telescoping toilet mounting assemblies as disclosed herein permit the practicing of a method for mounting a toilet with a toilet base to a floor, a wastewater pipe, and a lower female flange section. The method is founded on providing a telescoping toilet mounting assembly as taught herein. The mounting assembly can comprise an upper male flange section for being mounted concentric with the wastewater discharge port of the toilet base. The upper male flange section has a ring with first and second spaced mounting holes for aligning with the first and second mounting holes of the toilet base and a tubular wall portion to be received into the lower female flange section. First and second hollow bolts are provided for being respectively received through the first and second mounting holes of the upper male flange section and through the first and second mounting holes of the toilet base. The hollow bolts have exterior threads and broadened head portions, and first and second base bolt nuts are provided for being tightened on to the exterior threads of the first and second hollow bolts respectively. Further, first and second fastening bolt structures are provided, each fastening bolt structure with a bolt head, a threaded tip, and a body portion that is adjustable in length from the bolt head to the threaded tip, and first and second mounting members are included for being fixed to the lower female flange section.

With such a mounting assembly provided, the upper male flange section can be attached to the toilet base by passing the first and second hollow bolts through the first and second mounting holes of the upper male flange section and through the first and second mounting holes of the toilet base and tightening the first and second base bolt nuts onto the first and second hollow bolts. With the toilet and the upper male flange section so joined, the toilet and the upper male flange section can be applied to the lower female flange section with the tubular wall portion of the upper male flange section received into the tubular wall portion of the lower female flange section. Then, the toilet base and the upper male flange section can be attached to the lower female flange section and the wastewater pipe by passing the first and second fastening bolt structures through the first and second hollow bolts and into threaded engagement with the first and second mounting members with the first and second mounting members fixed in relation to the lower female flange section.

Practices of the method can include mounting the lower female flange section to the floor and the wastewater pipe. By way of non-limiting example, where each mounting plate further has at least one mounting aperture disposed through the mounting plate spaced from the locking aperture and at least one aligned mounting aperture disposed through the ring portion of the lower female flange section, mounting the lower female flange section to the floor and the wastewater pipe can include passing mounting fasteners through the mounting apertures in the mounting plates and the lower female flange section and into a flooring material. For instance, where the flooring material comprises a concrete flooring material, the step of passing mounting fasteners through the mounting apertures and into the flooring material can comprise passing the mounting fasteners through the mounting apertures and into threaded anchor bolts embedded in the concrete flooring material. In such practices of the invention, the method can further include embedding the threaded anchoring bolts in the concrete flooring material, such as while the concrete flooring material is setting, by drilling and fixing in place, or in any other manner. Where the flooring material comprises a wood flooring material, the step of passing mounting fasteners through the mounting apertures and into the flooring material can comprise passing screw mounting fasteners through the mounting apertures and screwing the mounting fasteners into the wood flooring material.

The telescoping toilet closet flange in certain embodiments can incorporate a two-part assembly that utilizes a combination of an upper male section that is attached by screws or bolts, for example, to the underside of the toilet base through the innermost area of standardized elongate holes in the toilet base into a steel plate set on top of the toilet base and a lower female section that is attached to the toilet base support surface or floor into which the upper section is positioned. An annular layer of adhesive sealant is deposed on a flattened area between the upper male section and the bottom of the toilet. This creates a rugged and watertight seal that cannot be dislodged while setting the toilet. The upper male section can be fitted with one or a plurality of O-rings or ribbed type seals disposed around its outer circumference to promote a watertight seal with the lower female section.

It is a feature of practices of the invention to provide a method for precisely aligning the upper male section with its adhesive sealant and attaching it to the bottom of the toilet in the correct location centered around the discharge horn of the toilet. Attachment screws are positioned in the openings of the flange and are firmly held while the ends of the screws are pushed through the mounting holes in the toilet base.

It is another feature of embodiments of the toilet mounting flange and method to provide a washer plate to be set on top of the toilet base with a threaded hole to receive the upper male section attachment screws or bolts and an unthreaded hole disposed adjacent thereto to bolt down the toilet to the lower female section of the flange.

Further features of embodiments of the invention include the use of the laterally elongated toilet base holes whose positioning, size, and spacing is standard to all toilet bases to allow two side-by-side screws or bolts to pass through each elongate hole to mount the toilet rather than the use of a singular, pre-placed standard anchor bolt. Embodiments are disclosed herein a single hollow bolt with exterior threads is permanently attached to each side of the upper male flange section allowing attachment to the bottom of the toilet and permitting an additional bolt to pass inside the hollow bolt to secure the toilet to the lower female flange section. An efficient, direct bolting down of the toilet to the lower part of the closet flange is permitted without the need for conventional anchor bolts or a wax ring. The lower female section of the present invention can be provided with standard predrilled holes to screw the device to subflooring and threaded holes aligned to the outermost area of the toilet base elongate holes.

The toilet is thus provided with a variable or telescoping watertight height tolerance. The lower female section of the flange can be installed directly to a subfloor during rough plumbing procedures thereby reducing the number of installation processes requiring additional visits by a plumber. The rough plumbing process for practices of the present invention can include permanent attachment of the lower female section to the waste pipe and floor. Flooring materials can abut the edge of the lower section of the flange and no longer must be positioned beneath it.

Practices of the toilet mounting flange and method eliminate the need of an installer to acquire, purchase, or install additional seals, seal extensions, or separate devices to create a watertight and dependable seal, such as might otherwise be required due to increased or decreased proximity to a closet flange, such as due to varying thicknesses of flooring material installed under the toilet base. Without limitation except as may be included in the claims, the upper and lower sections can be formed entirely of metal or plastic or combinations of metal and plastic or from any other suitable material. It is contemplated further that the upper male section can be used independently of the lower female section, such as by being attached to a toilet and fit directly inside of a fixed pipe with the toilet screwed directly to the floor. Still further, an additional lower female flange section can be provided that is specifically designed to be embedded in concrete thereby allowing an installer to create a rigid bolting down of the toilet without drilling into the concrete slab.

In another embodiment, the telescoping toilet mounting assembly again includes a lower female flange section with a ring portion and a tubular wall portion and an upper male flange section for being mounted concentric with the wastewater discharge port of the toilet base. The upper male flange section has a ring portion with first and second spaced mounting holes for aligning with the first and second mounting holes of the toilet base and a tubular wall portion to be received into the lower female flange section. First and second hollow bolts are provided for being respectively retained in concentric alignment with the first and second mounting holes of the upper male flange section and for passing through the first and second mounting holes of the toilet base. The first and second hollow bolts have exterior threads and broadened head portions, which can comprise clamping plates. First and second bolts are included for being tightened onto the exterior threads of the first and second hollow bolts respectively, and first and second registration and locking rods are retained to project from the ring portion of the lower female flange section. The registration and locking rods are tubular and internally threaded. Further, first and second fastening bolts each have a bolt head and a threaded portion for being respectively received through the first and second hollow bolts and into threaded engagement with the first and second registration and locking rods.

Under such constructions, the upper male flange section can be attached to the toilet base by passing the first and second hollow bolts through the first and second mounting holes of the toilet base and tightening the first and second base bolt nuts onto the first and second hollow bolts. With the lower female flange section in place relative to a wastewater pipe, the toilet base and the upper male flange section can be attached to the lower female flange section and the wastewater pipe by aligning the first and second hollow bolts with the first and second registration and locking rods that project from the ring portion of the lower female flange section, causing the first and second locking rods to be received into the first and second hollow bolts, and by passing the first and second fastening bolts through the first and second hollow bolts and into threaded engagement with the first and second registration and locking rods.

In particular embodiments, each clamping plate comprises an arcuate clamping plate. In such manifestations of the mounting assembly, arcuate furrows can then be disposed in an underside of the ring of the upper male flange section for receiving the clamping plates.

To establish a watertight connection between the upper male flange section and the toilet base, an annular sealant ring can be disposed between therebetween. Furthermore, a sealant ring can be interposed between the tubular wall portions of the upper male flange section and the lower female flange section to ensure a fluid-tight relationship therebetween.

According to embodiments of the mounting assembly, each registration and locking rod can be retained relative to the lower female flange section by a mounting member, such as a mounting plate. In such embodiments, arcuate furrows can be disposed in the ring portion of the lower female flange section, and each mounting plate can comprise an arcuate mounting plate for being received in one of the arcuate furrows in the ring portion of the lower female flange section. Still further, first and second mounting apertures can be disposed through each mounting plate spaced from the registration and locking rod so that mounting fasteners can be passed through the mounting apertures, through the lower female flange section, and into a flooring material.

In certain embodiments of the mounting assembly, each registration and locking rod has a lower projecting portion that extends downwardly beyond the mounting member by a distance, and each registration and locking rod has an upper projecting portion that projects upwardly from the mounting member by a distance. As a result, the upper projecting portions of the registration and locking rods act as upstanding registration pins for engaging and being received into the hollow bolts, and the lower projecting portions of the registration and locking rods can be received into apertures in the lower female flange section to line the same to facilitate a robust and stable engagement.

Such embodiments of the mounting assembly can be employed to practice a method for mounting a toilet to a floor and a wastewater pipe. The method can begin with providing a telescoping toilet mounting assembly as described above. Then, the upper male flange section can be attached to the toilet base by passing the first and second hollow bolts through the first and second mounting holes of the toilet base and tightening the first and second base bolt nuts onto the first and second hollow bolts. The lower female flange section can be mounted concentrically with the wastewater pipe with the first and second registration and locking rods retained to project upwardly therefrom. With the upper and lower flange sections so retained, the toilet base and the upper male flange section can be attached to the lower female flange section and the wastewater pipe by aligning the first and second hollow bolts with the first and second registration and locking rods and causing the first and second locking rods to be received into the first and second hollow bolts. Then, the first and second fastening bolts can be passed through the first and second hollow bolts and into threaded engagement with the first and second registration and locking rods to lock the toilet in place relative to the floor in an aligned manner without a need for a messy wax ring or the cumbersome and frustrating installation involved with prior art toilet bolt assemblies.

One will appreciate that the foregoing discussion broadly outlines the more important goals and features of the invention to enable a better understanding of the detailed description that follows and to instill a better appreciation of the inventors' contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

The telescoping toilet mounting flange and the method for installing toilets using such flanges disclosed herein are subject to a variety of embodiments, each within the scope of the invention. However, to ensure that one skilled in the art will be able to understand and, in appropriate cases, practice the present invention, certain preferred embodiments of the broader invention revealed herein are described below and shown in the accompanying drawing figures.

Figure 1:
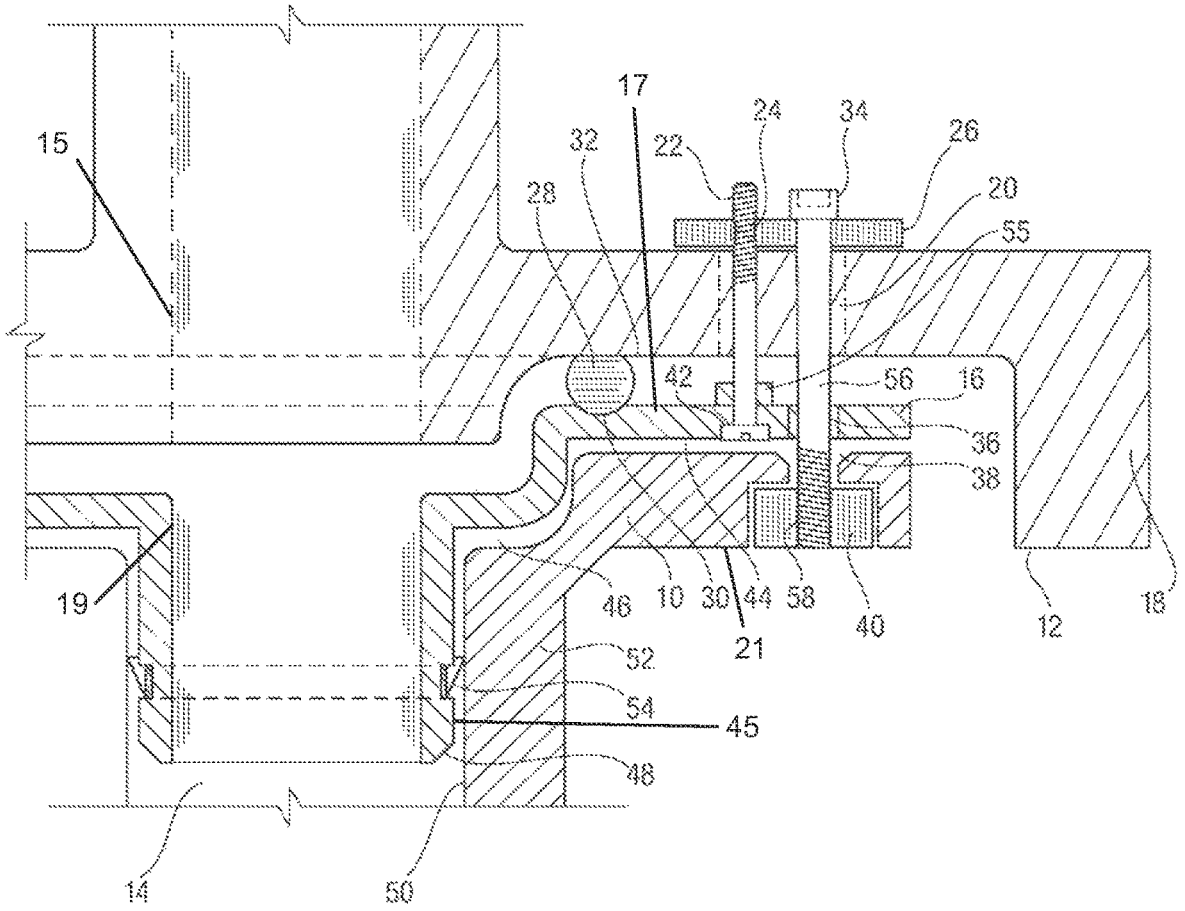
FIG. 1 is a cross-sectional view of an embodiment of the present invention for a telescoping toilet mounting flange positioned for mounting a toilet.

Referring to FIG. 1, a cross-sectional view in front elevation of a telescoping toilet mounting system according to the invention is depicted. It will be understood that, while FIG. 1 primarily depicts one side of the telescoping toilet mounting system and one side of the toilet base 18 to be mounted, the second side of the telescoping toilet mounting system and the toilet base 18 are similarly constructed and mounted.

In FIG. 1, a lower female flange structure 10 is retained to be received into a floor and wastewater pipe 14 that is disposed therebelow. An upper male flange section 16 is attached to the toilet base 18. Attachment screws 22 disposed to each side of the toilet base 18 are threaded into female threads 24 of a mounting plate 26, which can be a mounting plate 26 of steel or another material, that is disposed atop the toilet base 18. Left and right screws 22, one to each side of the base 18, pass through mounting holes in the upper male flange section 16 and are tightened to compress sealant material 28 that is prepositioned in a lowered contact area 30 to contact an underside 32 of the toilet base 18. The sealant material 28 creates a watertight seal between the upper flange 16 and the underside 32 of the toilet base 18. The upper male flange section 16 can thus be attached to the toilet base 18 prior to engagement with the lower female flange structure 10 and prior to engagement with the floor structure, such as while the toilet is fully accessible while rested on its side or back.

During the mounting process, the toilet base 18 and the upper male flange section 16 are attached at each side thereof to the lower female flange 10 by a bolt 34 that passes through the mounting plate 26, through the toilet base 18, through a hole 36 in the upper flange 16, and through a tapered opening 38 in the lower female flange structure 10 then to be threaded into a floor mounting plate 40. The floor mounting plate 40 can be of steel or another material. The upper male flange section 16 has a recessed area 42 on the planar lower surface 44 thereof to allow the head of the screw 22 be received therein, such as to be flush or nearly flush with the planar lower surface 44 of the upper flange 16. This allows a clearance 46 space to be minimized.

With the upper male flange section 16 attached to the toilet base 18, the toilet base 18 and the upper male flange section 16 attached thereto are lowered into place. The upper male flange section 16 has a tapered distal end 48 that is readily aligned with and received within an inner sidewall 50 of a lower tubular wall section 52 of the lower female flange structure 10. An annular, ribbed sanitary seal 54 creates a water and gas proof seal between the lower female flange structure 10 and the upper male flange section. Over-compression of the sealant material 28 is prevented by an integral proximity stop 55, which can, by way of example and not limitation, be interposed between the upper male flange section 16 and the underside 32 of the toilet base 18. For instance, in the depicted embodiment, the proximity stop 55 surrounds the shank 56 of the attachment screw 22 thereby to prevent over-compression of the sealant material 28 or a stressing and possibly cracking the entire upper male flange section 16.

Embodiments of the invention can thus be characterized as a telescoping toilet mounting flange system for the installation and connection of a toilet base 18 to a floor and waste water pipe 14. The toilet base 18 has two spaced mounting holes 20, one on each side of the base 18, and a wastewater discharge port 15. The telescoping toilet mounting flange system comprises an upper male section 16 attachable to the toilet base 18 through the toilet base mounting holes 20. As seen, for instance, in FIG. 1, the upper male section 16 comprises a ring 17 that has an interior port 19 concentric with the toilet base wastewater discharge port 15. The ring 17 of the upper male section 16 further has two spaced apart mounting holes 36 arranged to be aligned with the toilet base mounting holes 20. The ring 17 further has a flanged tubular portion 45 with a tapered end 48 arranged to extend downward into the wastewater pipe 14.

An upper male section attachment ring connection is thus formed by the bolts 22 as they are upwardly disposed through the mounting holes in the ring 17 of the upper male flange section 16 and through the toilet base mounting holes 20 to threadedly engage the plate 26 disposed atop each of the toilet base mounting holes 20 for receiving the bolt 22. The sealant material 28, which can comprise an adhesive sealant ring 28, disposed between the toilet base 18 and upper male flange section 16 is arranged to be concentric with the interior port 19 of the upper male flange section 16 and the toilet discharge opening 15. The sealant ring 28 is arranged to be compressed upon a tightening of the bolts 22 in relation to the threaded plates 26.

The lower female flange structure 10 is attachable to a floor structure. As shown in FIG. 1, for example, mounting plates 40 with threaded bolt-down holes 58 can be disposed below the tapered openings 38 in the lower female flange structure 10. During installation, the bolt-down holes 58 are aligned with the toilet base mounting holes 20 to permit the toilet base 18 to be top-bolted and mounting to the waste water pipe 14 and to the surrounding floor structure. The lower female flange section 10 has a circular ring portion 21 that is disposed a facing relationship with the ring 17 of the upper male flange section 16 and a flanged tubular wall section portion 52 that, when installed, extends downwardly into the waste water pipe 14. The sealant ring 28 is disposed between the rings 17 and 21 of the upper male flange section 16 and the lower female flange section 10.

Figure 2:
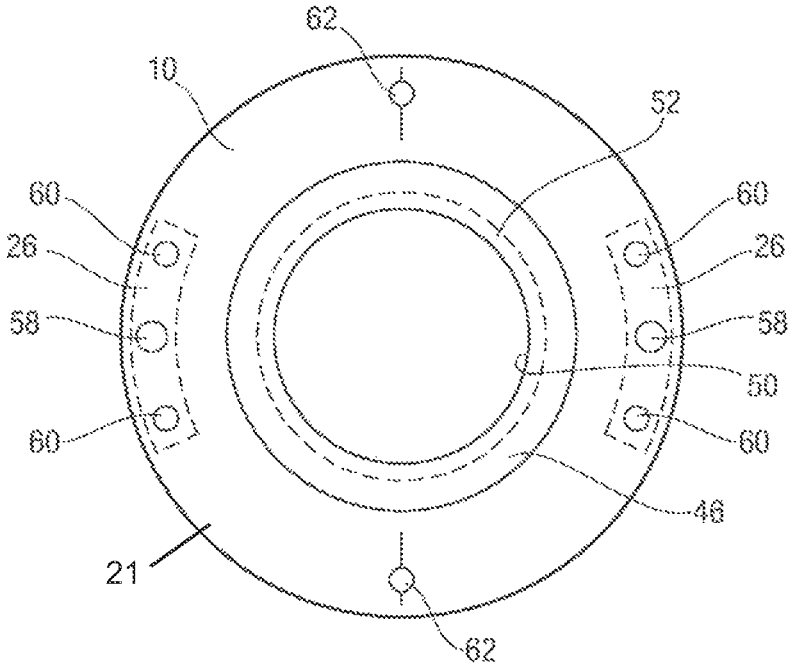
FIG. 2 is a top plan view of a lower female flange section of the telescoping toilet mounting flange.

The lower female flange section 10 can be further understood with reference to FIG. 2 where the lower female flange section 10 is shown in a top plan view. There, mounting plates 40, which in this embodiment comprise arcuate mounting plates 40, are shown to be embedded or otherwise disposed in the underside of the ring portion 21 of the lower female flange section 10. Threaded bolt-down holes 58 are shown centered in the mounting plates 40 and in the ring portion 21 of the lower female flange section 10 between screw-down holes 60 that are disposed through the ring portion 21 of the lower female flange section 10 and the mounting plates 40 for permitting direct attachment, such as by screws, to a floor structure. Supplemental screw-down holes 62 are disposed in opposition through the ring portion 21 spaced from the screw-down holes 60 to provide for supplemental floor attachment as may be required for additional strength.

Figure 3:
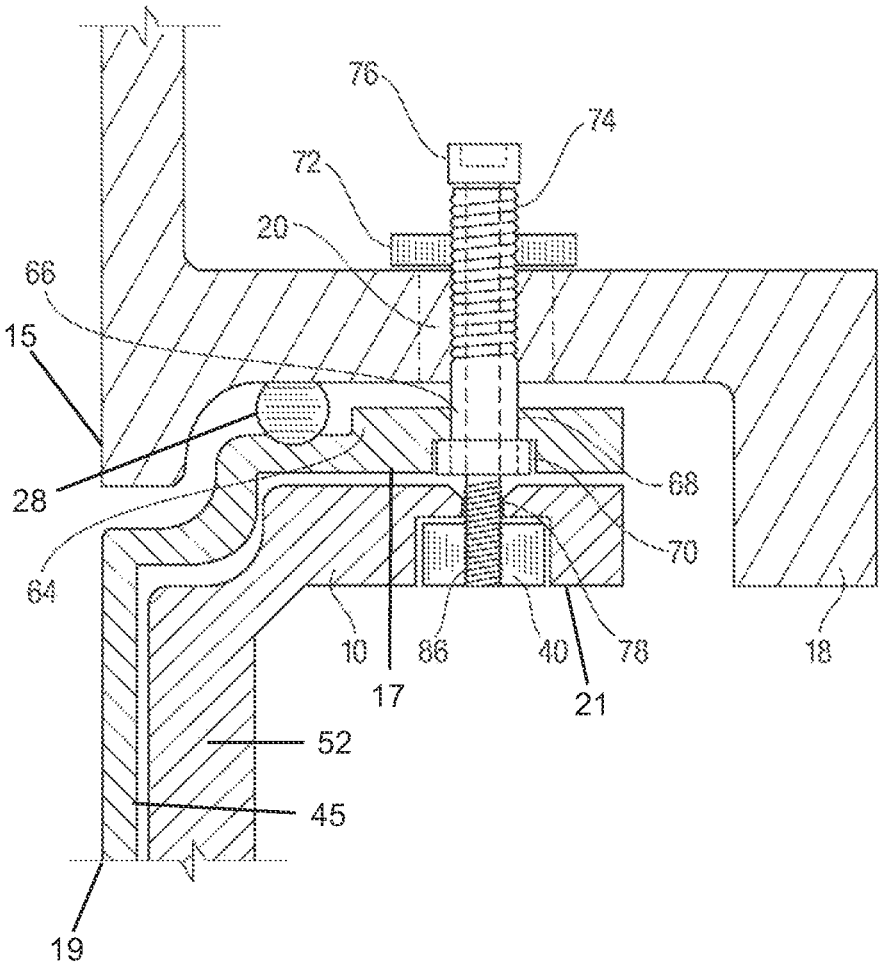
FIG. 3 is a cross-sectional view of an alternative telescoping toilet mounting flange according to the present invention.
Figure 7:
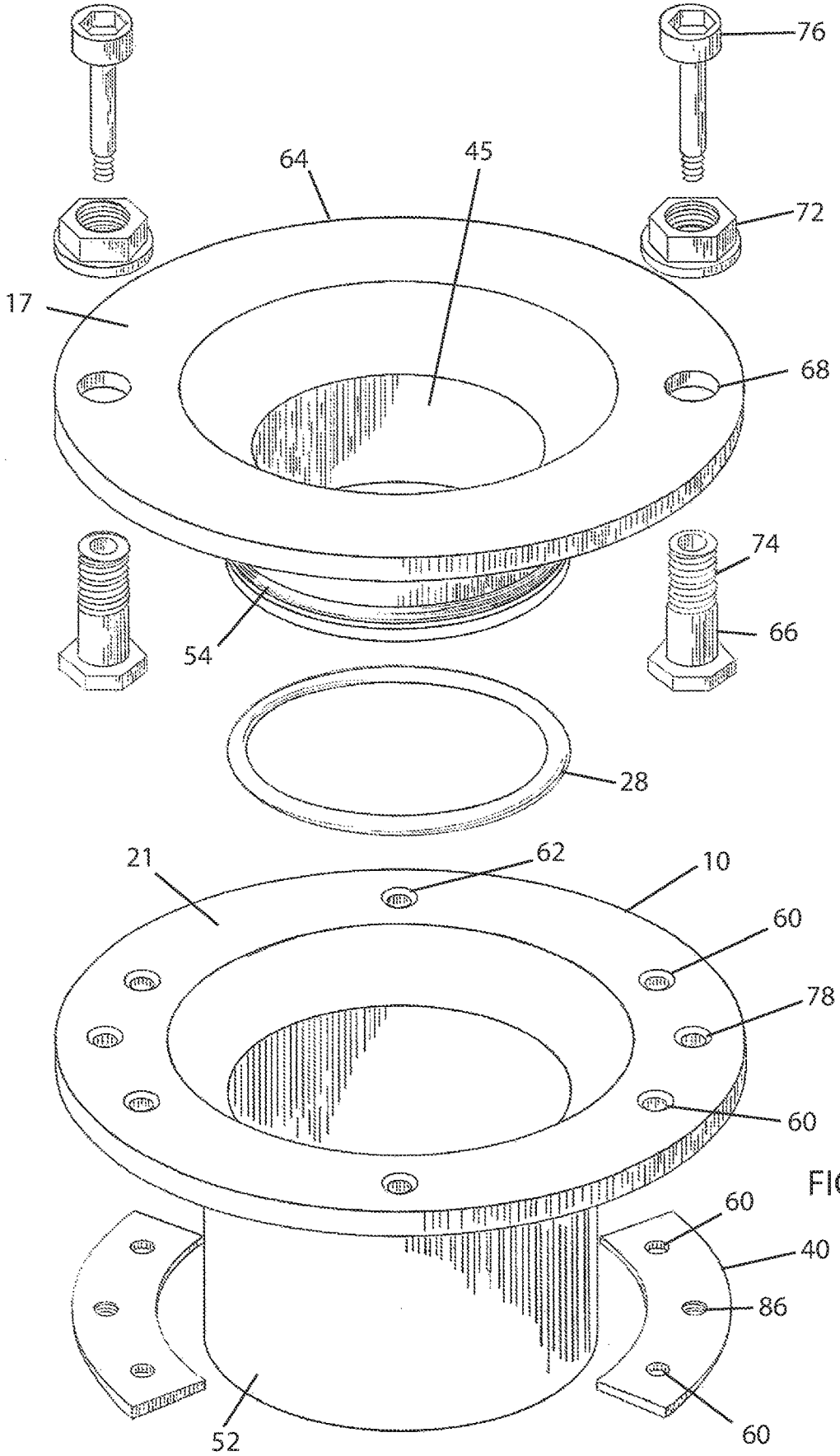
FIG. 7 is an exploded perspective view of the telescoping toilet mounting flange of FIG. 3.
Figure 8:
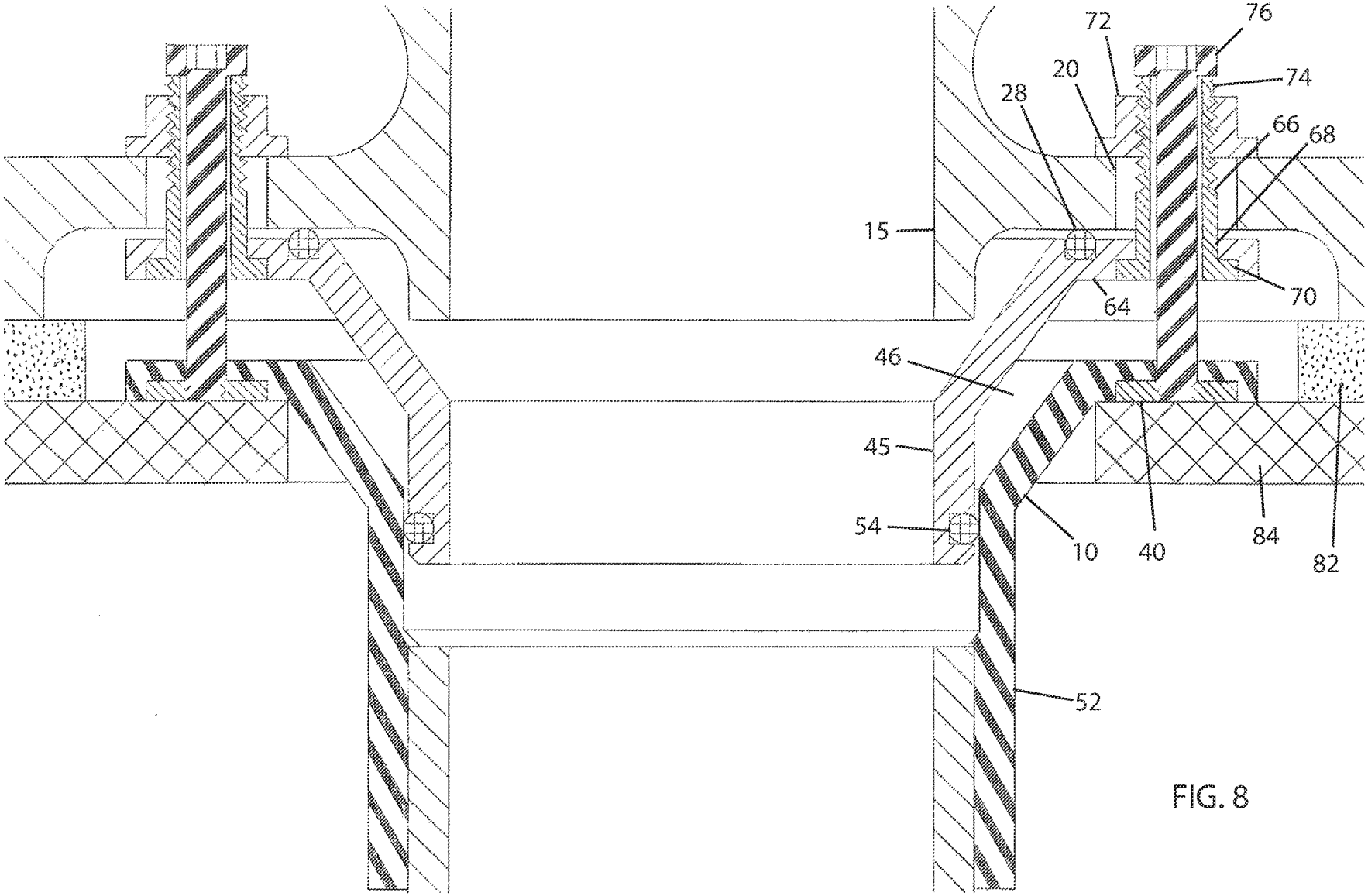
FIG. 8 is a cross-sectional view of the telescoping toilet mounting flange of FIGS. 3 and 7 positioned mounting a toilet.

Turning to FIG. 3, an alternative embodiment of the telescoping toilet mounting system is shown, and components of such a telescoping toilet mounting system, albeit with certain variations thereto, are shown in FIGS. 7 and 8. In FIG. 3, one side of the telescoping toilet mounting system and one side of the toilet base 18 are shown with the understanding that the second side of the telescoping toilet mounting system and the toilet base 18 are similarly constructed and mounted as mirror images thereof. Components of the mounting system are shown in an exploded view in FIG. 7 and in cross section in FIG. 8.

There, an upper male flange section 64 is attached to the underside of a toilet base 18 utilizing two hollow bolts 66, one to each side of the toilet base 18. The bolts 66 are slid through hole 68 through the upper male flange section 64. The heads of the bolts 66, which can be square, hexagonal, or otherwise non-round shapes, are captured in correspondingly square, hexagonal, or otherwise non-round recesses 70, and the bolts 66 are further slid through the oval holes 20 common to all toilet bases. The upper male flange section 64 is secured in place and a watertight relationship is established between the upper male flange section 64 and the toilet base 18 as the waterproof sanitary seal 28 interposed between the upper male flange section 64 and the toilet base 18 is compressed by tightening a toilet base bolt nut 72 onto the exterior threads 74 of the bolt 66.

In a marked improvement over the prior art, with the upper male flange section 64 fixed in place relative to the toilet base 18 and with the tubular portion 45 of the upper male flange section 64 projecting concentrically beyond the exhaust port 15 of the toilet base 18, installation can then be rapidly and efficiently completed. The tubular portion 45 of the upper male flange section 64 can be slid into the lower tubular wall section 52 of the lower female flange structure 10 to cause the rings 17 and 21 of the upper male flange section 64 and the lower female flange section 10 to be disposed in a concentric, facing relationship. The toilet can then be fixed in place by passing toilet bolt down screws 76 through the hollow bolts 66, through tapered openings 78 in the lower female flange structure 10, and to have threaded tips of the screws 76 received into threaded holes 86 in the floor mounting plates 40 and tightening the screws 76 to both sides of toilet base 18. The tapered openings 78 in the lower female flange section 10 and the threaded holes 86 in the mounting plates 40 are again centered in the ring portion 21 of the lower female flange section 10 between screw-down holes 60 that are disposed through the ring portion 21 of the lower female flange section 10 and the mounting plates 40 for permitting direct attachment, such as by screws, to a floor structure.

Supplemental screw-down holes 62 are disposed in opposition through the ring portion 21 spaced from the screw-down holes 60 to provide for supplemental floor attachment as may be required for additional strength. The telescoping capability of toilet mounting system can be further recognized in FIG. 8, for example, where additional flooring material 82, such as tile or any other material, is disposed under the toilet base 18 while the lower female flange section 10 is attached directly to the subfloor 84. With the additional flooring material 82 in place, clearance 46 is expanded. Nonetheless, a watertight seal is maintained between the toilet base 18 and the upper male flange section 64 and between the upper male flange section 64 and the lower female flange section 10 by operation of the ring of sealant 28 and the circular ribbed sanitary seal 54.

Figure 4:
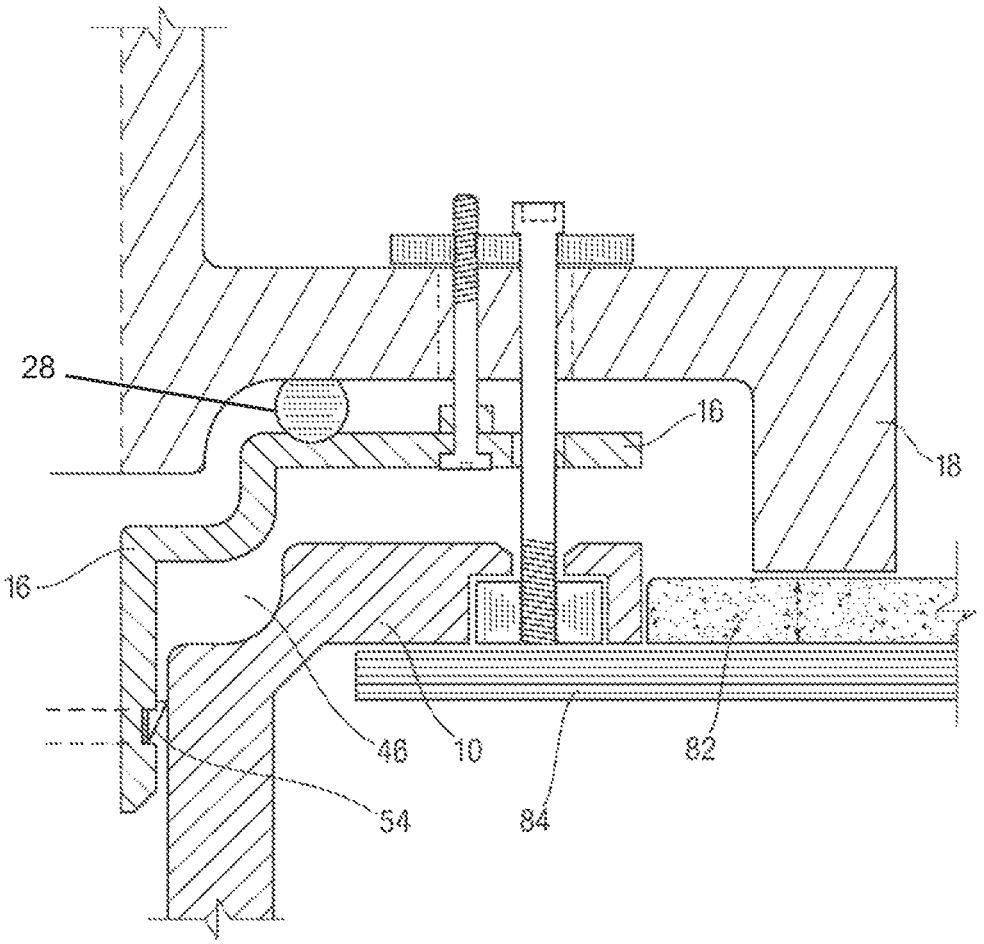
FIG. 4 is a cross-sectional view of an embodiment of the telescoping toilet mounting flange positioned mounting a toilet in relation to a floor structure.

FIG. 4 depicts the telescoping toilet mounting system of FIG. 1 employed in mounting a toilet to a floor structure comprising a subfloor 84 and additional flooring material 82, such as tile or any other flooring material, disposed atop the subfloor 84. There, the telescoping capability of the invention is again exhibited where the additional flooring material 82 is disposed under the toilet base 18 while the lower female flange section 10 is attached directly to the subfloor 84. With the upper male flange section 16 fixed in relation to the toilet base 18 and the toilet base 18 elevated by the additional flooring material 82, the clearance 46 has accordingly been expanded. Despite that expanded clearance 46, a watertight seal is ensured by the circular ribbed sanitary seal 54 between the upper male flange section 16 and the lower female flange section 10 and by the sealant ring 28 compressed between the upper male flange section 16 and the toilet base 18.

Figure 5:
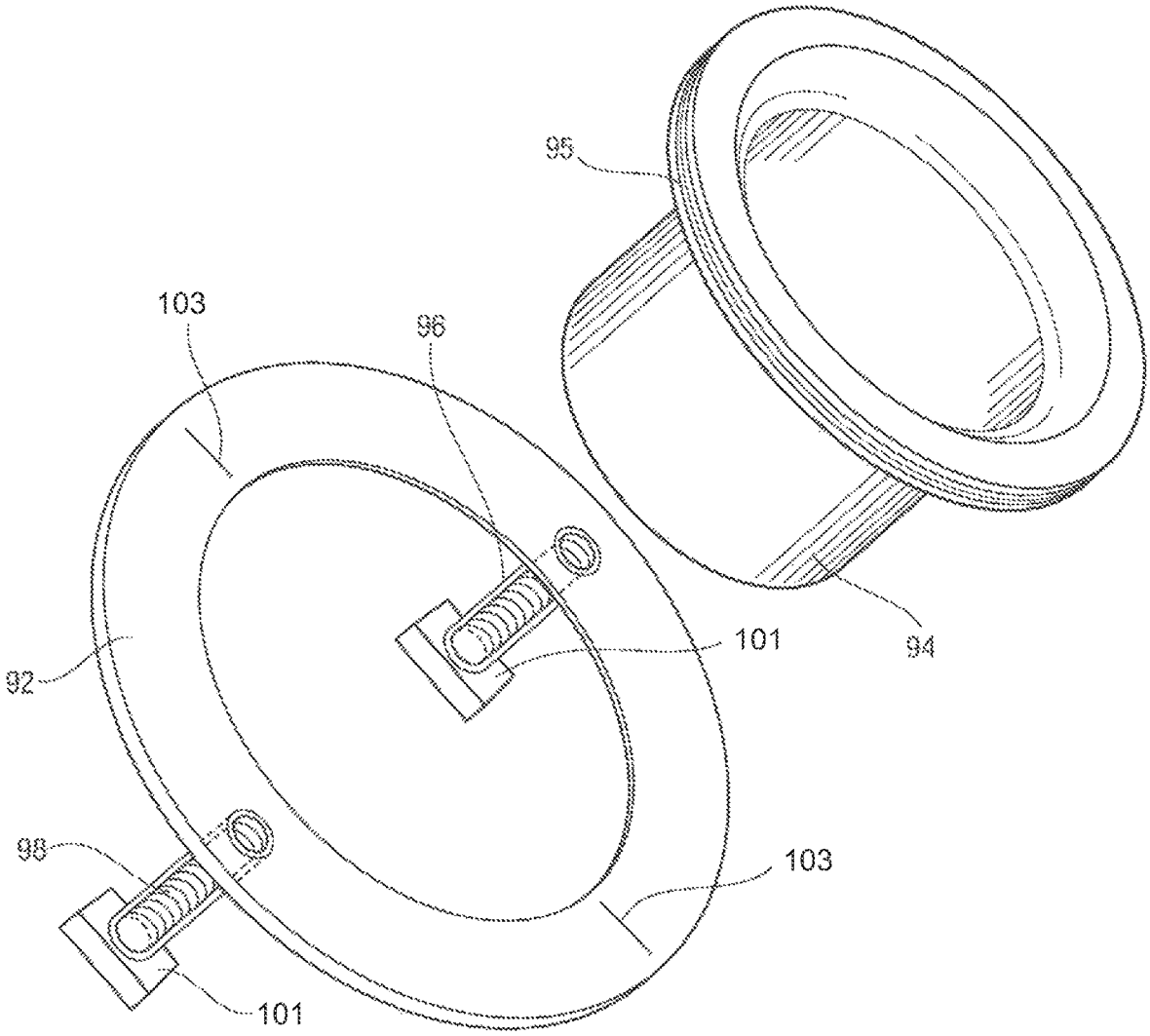
FIG. 5 is an exploded perspective view of an alternative embodiment of the telescoping toilet mounting flange.
Figure 6:
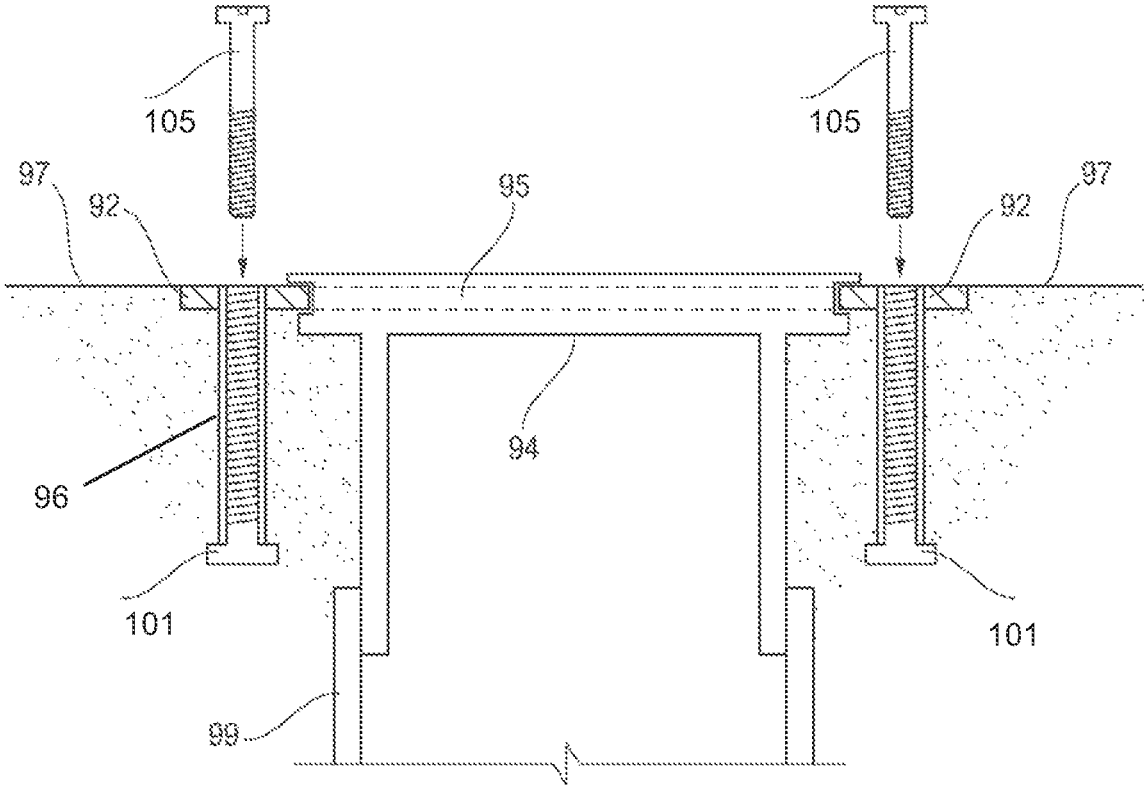
FIG. 6 is a cross-sectional view of the telescoping toilet mounting flange of FIG. 5 during mounting in relation to a floor structure.

FIGS. 5 and 6 depict an alternative embodiment of the lower female flange portion of a telescopic toilet mounting system as disclosed herein. There, the lower female flange portion is designed to be embedded in a poured concrete floor while the concrete is in liquid form. The lower female flange portion has an upper washer-shaped ring 92, which could be a steel upper washer-shaped ring 92, that is rotatably attached to a lower wastewater pipe connection 94, which could be a plastic lower wastewater pipe connection 94. For example, the washer-shaped ring 92 can be rotatably engaged with grooves 95 disposed within a ring portion of the wastewater pipe connection. Two tubular sleeves 96 with interior threads 98 are firmly attached to the ring 92. A metal foot 101 is firmly attached at the bottom of each sleeve 96.

Under this construction, the sleeves 96 and the ring 92 and wastewater pipe connection 94 connected thereto are anchored in relation to the concrete floor when the concrete has hardened. The lower female flange portion so retained can further retain a toilet in relation to a concrete floor 97 and in relation to the wastewater pipe 99. The benefit of this embodiment is that an installer of a toilet will not have to drill into hardened concrete to attach a toilet flange and toilet to a floor 97 and waste pipe 99. Accordingly, as further shown in the cross-sectional view of FIG. 6, the upper circular ring 92 is thus rotatably attached to the lower wastewater pipe connection 94 with the two attached downward extending internally threaded sleeves 96 supported by feet 101 within the concrete floor 97. This structure thus provides pre-disposed, threaded holes in the form of the tubular sleeves 96 with interior threads 98 to permit bolting a toilet to the floor 97 and a waste pipe 99 by use of toilet base installation bolts 105 in much the same manner and with corresponding components as those shown and described in relation to FIG. 1 with respect to a wood floor structure.

The toilet attachment method of the embodiment of FIGS. 5 and 6 thus allows independent rotation of the upper ring 92 in relation to the wastewater pipe connection 94. The independent rotation of the upper ring 92 allows an installer, by way of example and not limitation, to glue the lower pipe connection 94 to the wastewater pipe 99 and then to rotate the upper ring 92 to the proper position, such as by using registration marks 103, in relation to the wall behind the toilet and at ninety degrees from sleeve 96 since concrete hardens considerably slower than traditional plastic cements.

Figure 9:
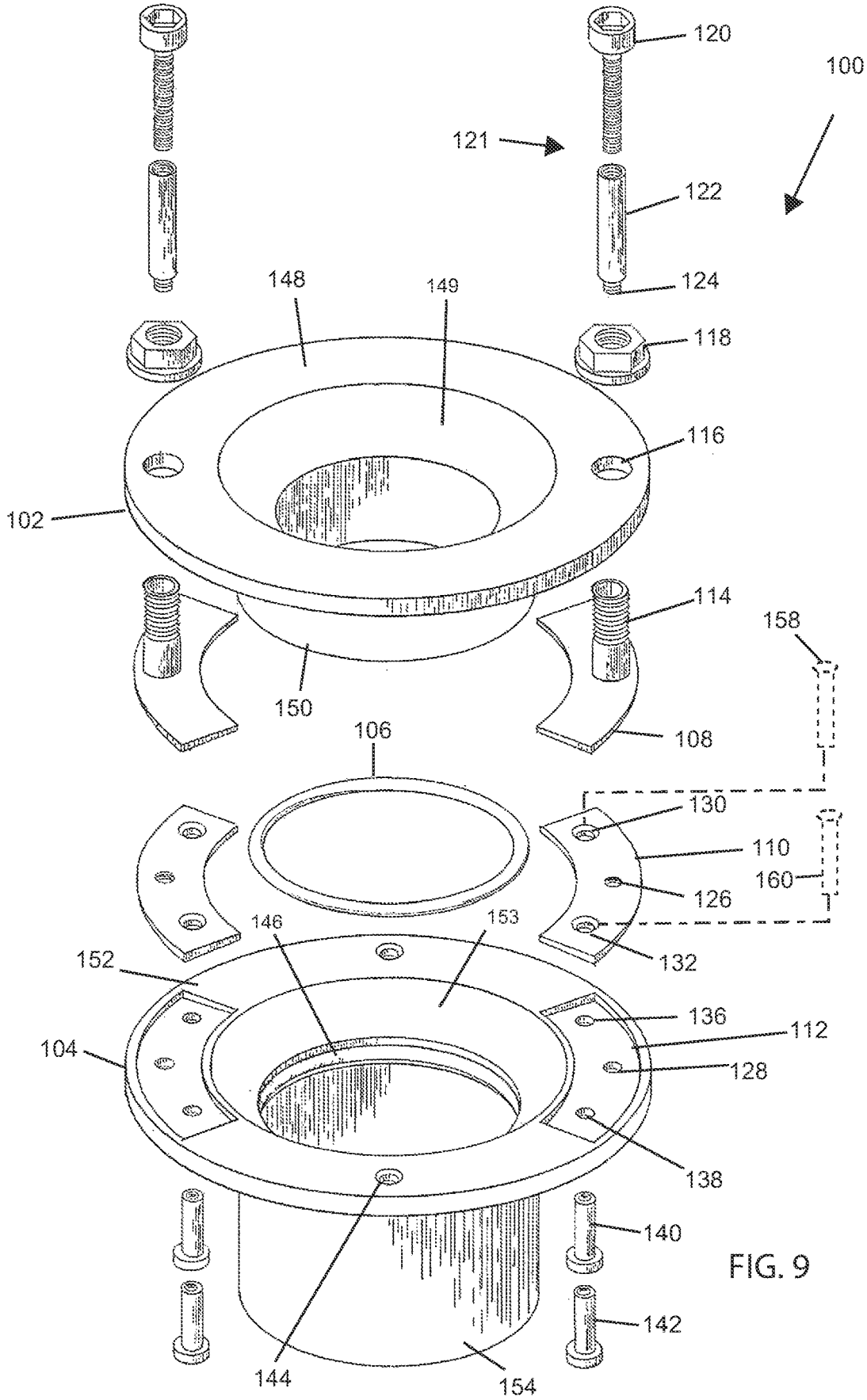
FIG. 9 is an exploded perspective view of an alternative embodiment of a telescoping toilet mounting system according to the invention.
Figure 10:
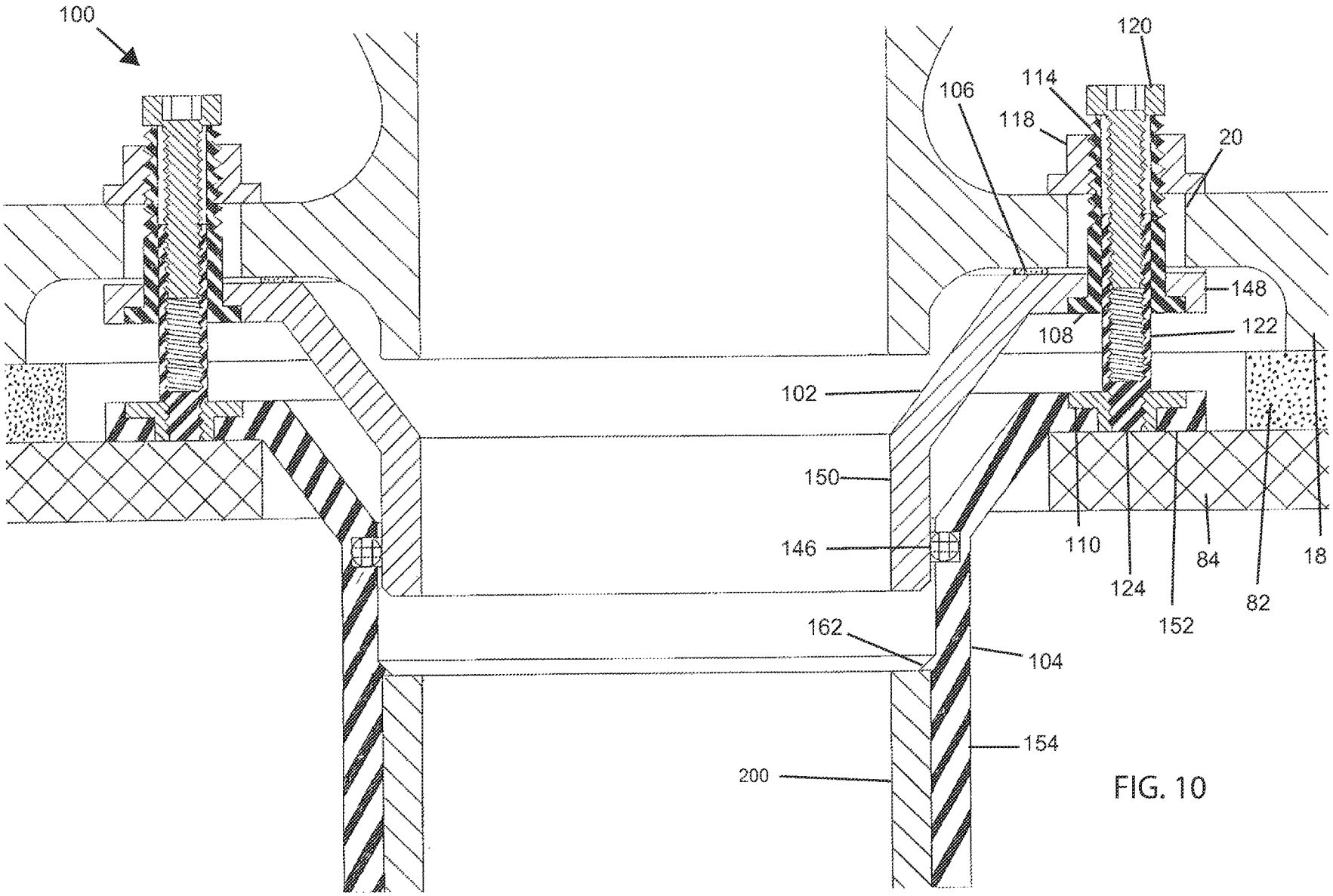
FIG. 10 is a cross-sectional view of the telescoping toilet mounting system of FIG. 9 positioned mounting a toilet in relation to a floor structure with a subfloor and a flooring material atop the substrate.
Figure 11:
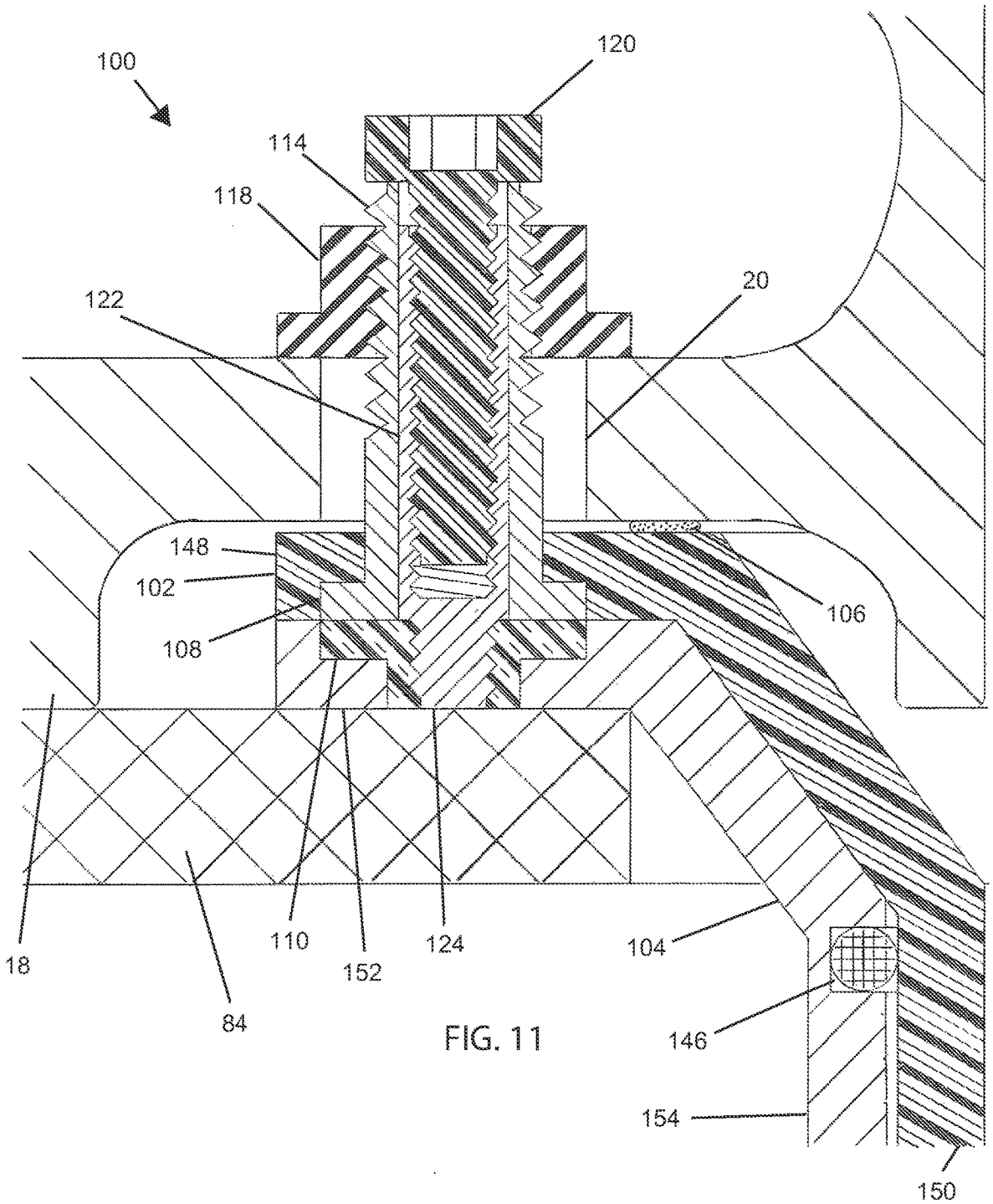
FIG. 11 is an amplified cross-sectional view of the telescoping toilet mounting system of FIG. 9, again positioned mounting a toilet in relation to a floor structure with a subfloor.

A further embodiment of the telescopic toilet mounting system is indicated generally at 100 in FIGS. 9 through 11. There, the mounting system 100 again includes an upper male flange section 102, which is shown apart from the system 100 in FIGS. 12A and 12B, that has an annular, flat ring portion 148 and a tubular wall portion 150 connected to the ring portion 148 by a conical portion 149. The mounting system 100 further includes a lower female flange section 104, which is shown apart from the system 100 in FIGS. 13A and 13B, that has an annular, flat ring portion 152 and a tubular wall portion 154 connected to the ring portion 152 by a conical portion 153. A sealing O-ring 146 is retained, such as by being received in an annular channel in the inner surface of the tubular wall portion 154, to be sealingly disposed between the tubular wall portion 150 of the upper male flange section 102 and the tubular wall portion 154 of the lower female flange section 104.

Figure 12B:
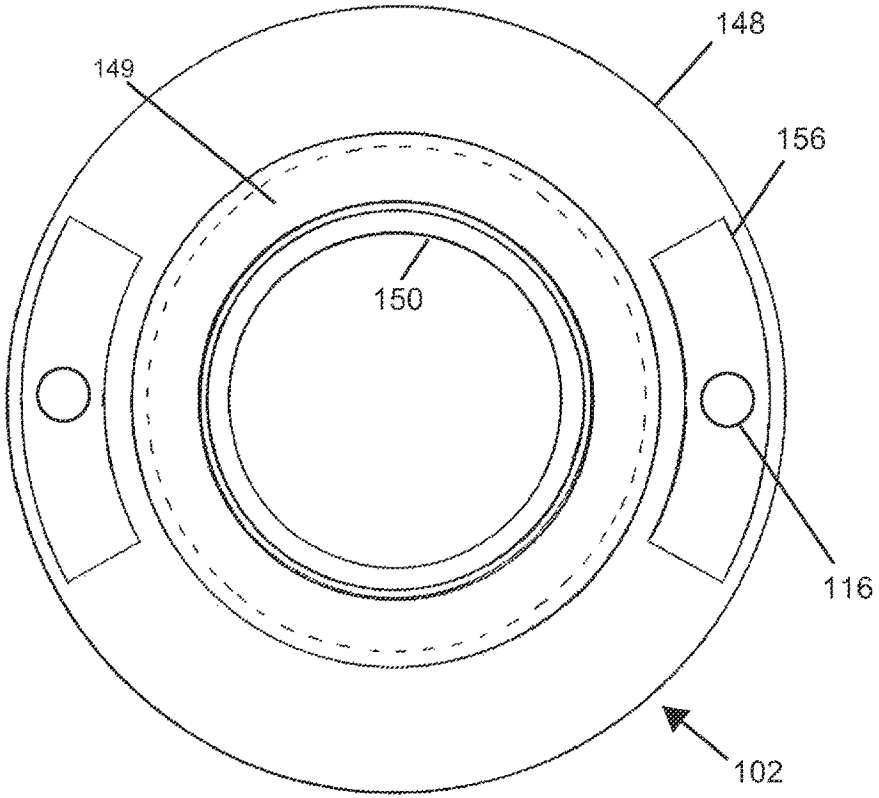
FIGS. 12A and 12B are bottom and top plan views of the male upper flange of the telescoping toilet mounting system of FIG. 9.
Figure 12A:
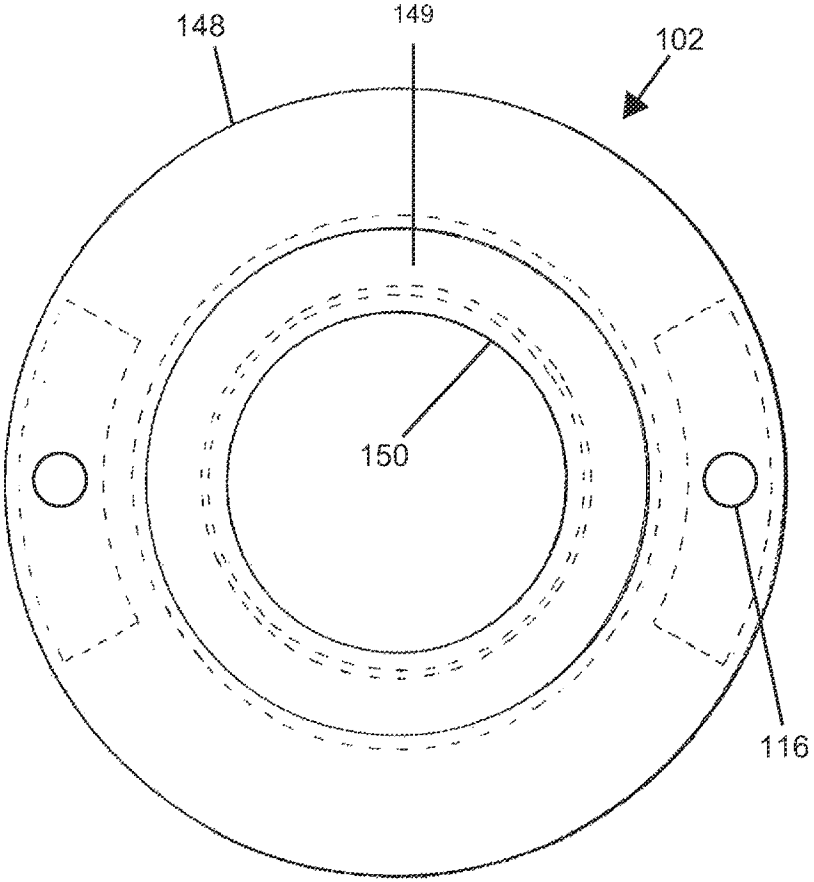

As best seen in FIGS. 12A and 12B, the ring portion 148 of the upper male flange section 102 has first and second arcuate furrows 156 disposed in opposition on the underside thereof, and first and second apertures 116 are disposed in opposition centrally within the furrows 156. The mounting system 100 includes first and second arcuate clamping plates 108 that are shaped and sized to be received into the arcuate furrows 156 in the upper male flange section 102. A hollow bolt 114 with a tubular interior is externally threaded and fixed to project from each clamping plate 108.

As shown, for instance, in FIGS. 10 and 11, with the clamping plate 108 disposed below the rim portion 148 of the upper male flange section 102 and the hollow bolts 114 can be received through the apertures 116 in the upper male flange section 102 and through the mounting holes 20 of the toilet base 18, hold-down nuts 118 can be threadedly engaged with the external threads of the hollow bolts 114 thereby fastening the upper male flange section 102 to the toilet base 18. An annular sealant ring 106, which is compressed upon tightening of the hold-down nuts 118, is again disposed between the upper male flange section 102 and the toilet base 18 to establish a watertight connection therebetween.

Figure 13B:
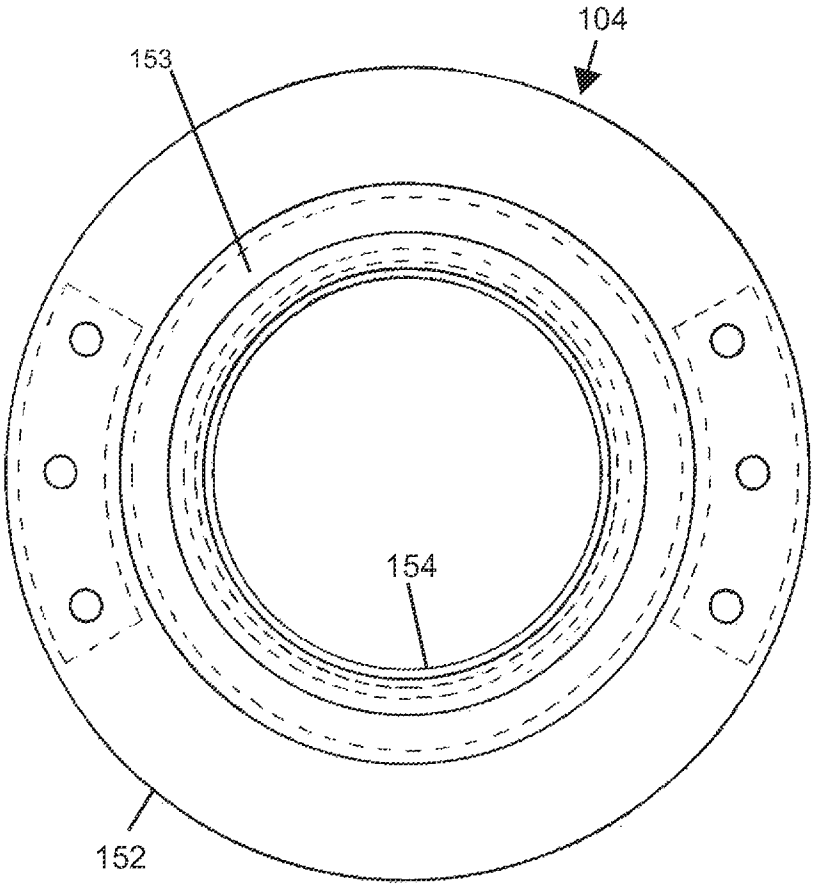
FIGS. 13A and 13B are bottom and top plan views of the female lower flange of the telescoping toilet mounting system of FIG. 9.
Figure 13A:
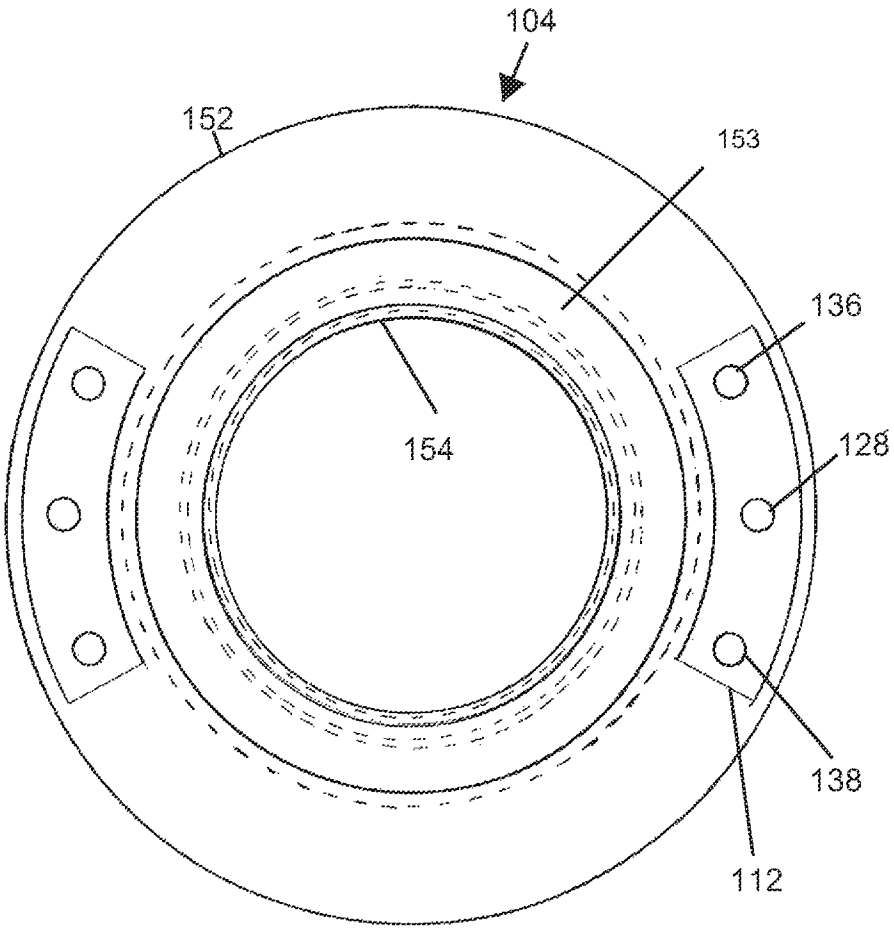

With more particular reference to FIGS. 13A and 13B, the lower female flange section 104 can be seen to have first and second arcuate furrows 112 disposed in opposition on the upper side thereof, and those furrows 112 receive and retain correspondingly sized and shaped arcuate mounting plates 110. A threaded central locking aperture 126 is disposed in each mounting plate 110 with a corresponding aperture 128 disposed through the lower female flange section 104, and first and second mounting apertures 130 and 132 are disposed through the mounting plate 110 outboard of the locking aperture 126 with aligned apertures 136 and 138 disposed through the lower female flange section 104.

In installing the mounting system 100, as will be discussed further hereinbelow, fasteners 158 and 160 can be driven through the apertures 130 and 136 and 132 and 138. In an installation relative to a room with a floor of wood or another material into which one can screw directly, the fasteners 158 and 160 can comprise wood screws. In other installations, such as in relation to a room with a formed material such as but not limited to concrete, the fasteners 158 and 160 can be threadedly received by internally threaded anchor bolts 140 and 142 that can be preset in the floor material as discussed, for instance, in relation to the embodiment of FIGS. 5 and 6. Where necessary, additional fasteners can be driven through supplemental apertures 144 in the lower female flange section 104 and into the flooring material.

Under this construction and with more particular reference to FIGS. 10 and 11, an installer can carry out an efficient and convenient method of mounting of a toilet in relation to a floor structure and wastewater pipe 200 by first fastening the upper male flange section 102 to a toilet base 18 and separately securing the lower female flange section 104 in relation to a floor structure, whether the toilet base 18 is to rest atop an additional flooring material 82 disposed atop a base floor material 84 as in FIG. 10 or directly on a base floor material 84 as in FIG. 11. By engagement of the hold-down nuts 118 with the hollow bolts 114, the clamping plates 108 are caused to clamp the upper male flange section 102 into fixed engagement with the toilet base 18 with the sealing O-ring 106 creating a liquid-tight relationship therebetween. By operation of the fasteners 158 and 160 passing through the mounting plate 110 and into the flooring material, whether by being directly screwed into the flooring material or by being screwed into anchor bolts 140 and 142 embedded in the flooring material, the lower female flange structure 104 is fixed in place. The tubular wall portion 154 of the lower female flange section 104 is matingly or otherwise sealingly engaged with a wastewater pipe 200 as, for example, in FIG. 10. A sealing O-ring 162 or another sealing mechanism can ensure a liquid-tight relationship between the lower female flange structure 104 and the wastewater pipe 200.

With the upper male flange section 102 fixed to the toilet base 18 and the lower female flange section 104 fixed relative to the floor structure and the wastewater pipe 200, the toilet can be quickly and reliably engaged with the wastewater pipe 200 by lowering the upper male flange section 102 into mating engagement with the lower female flange section 104 with the sealing O-ring 146 establishing a liquid-tight relationship between the flange sections 102 and 104. Then, the toilet can be fixed in place by application of a fastening bolt structure 121 with a bolt head and a threaded tip 124 that is passed through the hollow bolt 114 and into threaded engagement with the threaded aperture 126 in the mounting plate 110, which itself is fixed to the floor structure by the fasteners 158 and 160. With this, and notably without the messiness of the wax ring and the precarious toilet bolts required by the prior art, a toilet can be efficiently mounted in a reliably watertight manner.

In the depicted embodiment, the fastening bolt structure 121 has a body portion that is adjustable in length from the bolt head to the threaded tip 124. To accomplish this, the depicted fastening bolt structure 121 comprises a barrel bolt, often referred to as a sex bolt, formed by an internally threaded barrel sleeve 122 that terminates in the threaded tip 124 and a screw 120 that is threadedly received into the barrel sleeve 122. With this, the effective length of the fastening bolt structure 121 can be adjusted by rotation of the screw 120 within the barrel sleeve 122, and the concentric fastener construction of the fastening bolt structure 121 is operative to fix the toilet base 18 in place.

Such embodiments can readily accommodate varied distances between the toilet base 18 (and thus the upper end of the hollow bolt 114 securing the upper male flange section 102 to the toilet base) and the mounting plate 110 (and thus the floor structure to which the mounting plate 110 and the lower female flange section 104 are secured). As in FIG. 10, for example, where additional flooring material 82 raises the toilet base 18 higher above the base flooring 84, the fastening bolt structure 121 spans a greater length with the screw 120 received a given portion into the barrel sleeve 122. However, as in FIG. 11 where the additional flooring material 82 is not present, the fastening bolt structure 121 spans a lesser length with the screw 120 received a greater portion into the barrel sleeve 122.

As a result, a watertight connection can be established in varied installation situations using the same mounting system 100. The mounting system 100 provides an effective solution to the long-felt need for an efficient and convenient mounting solution for joining a toilet base 18 with a wastewater pipe 200 in a sealed manner. With the ability to mount the upper male flange section 102 to the toilet base 18 in a permanent manner and then to fasten the joined toilet base 18 and upper male flange section 102 to the lower female flange section 104 and wastewater pipe 200, the mounting system 100 provides a self-aligning structure that eliminates the need to lower a toilet precisely onto precariously upstanding bolts as is required by the structures of the known prior art, which often involves multiple separate sets of fasteners, messy wax rings, and loosely upstanding bolts onto which an installer must attempt to lower a heavy toilet.

Figure 14:
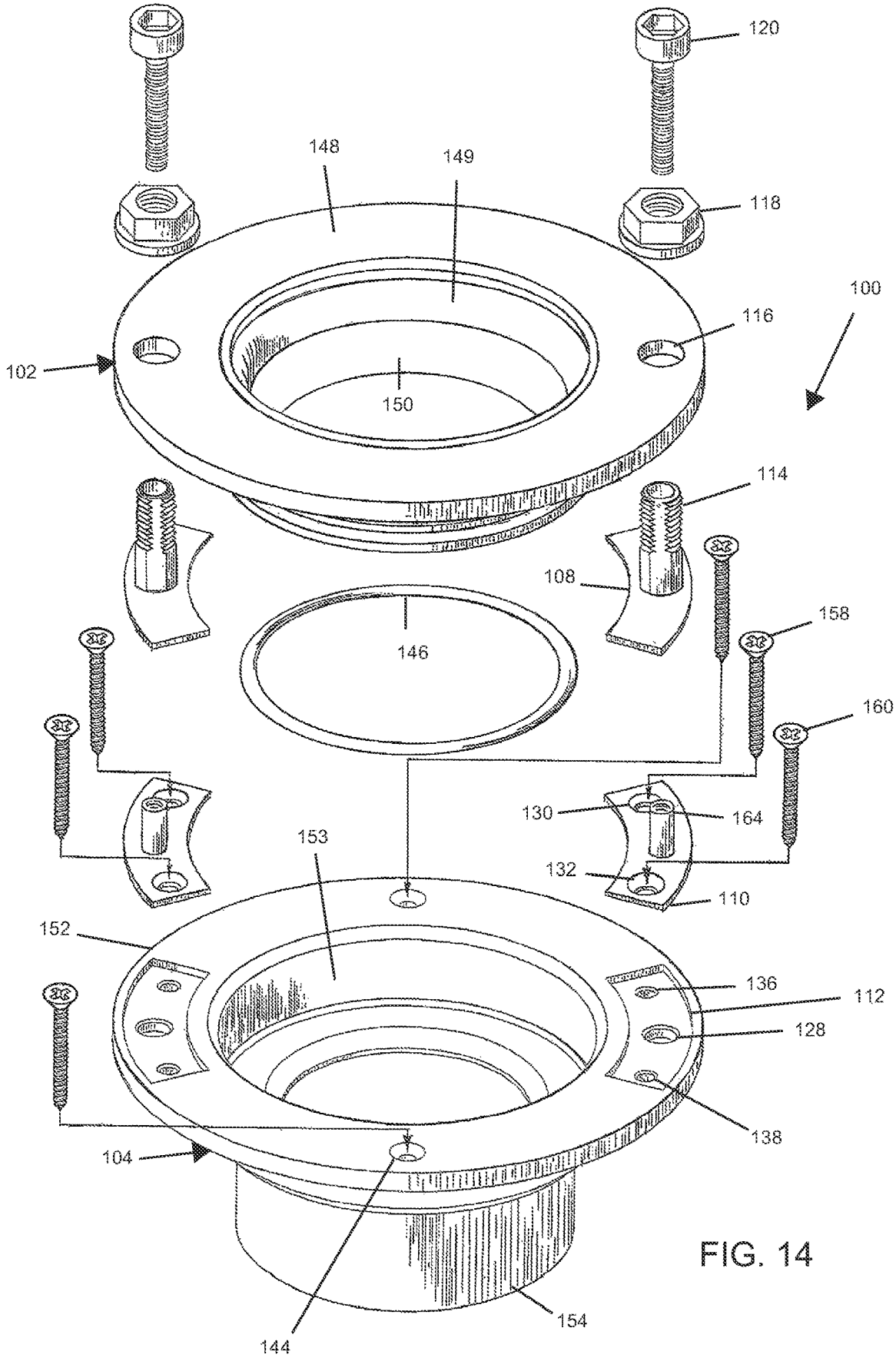
FIG. 14 is an exploded perspective view of another alternative embodiment of a telescoping toilet mounting system as disclosed herein.

Another embodiment of the telescopic toilet mounting system is indicated generally at 100 in FIG. 14. The mounting system 100 of the present embodiment includes an upper male flange section 102 and a lower female flange section 104. The upper male flange section 102 has an annular, flat ring portion 148 and a tubular wall portion 150 connected to the ring portion 148 by a connecting portion 149. The connecting portion 149 could again be frusto-conical, or the connecting portion 149 could comprise one or more annular stepped or shoulder portions, which themselves could have curved waterfall surfaces. The lower female flange section 104 has an annular, flat ring portion 152 and a tubular wall portion 154 that is connected to the ring portion 152 by a connecting portion 153, which again could be frusto-conical or formed with one or more annular stepped or shoulder portions, which again could have curved waterfall surfaces.

Figure 17B:
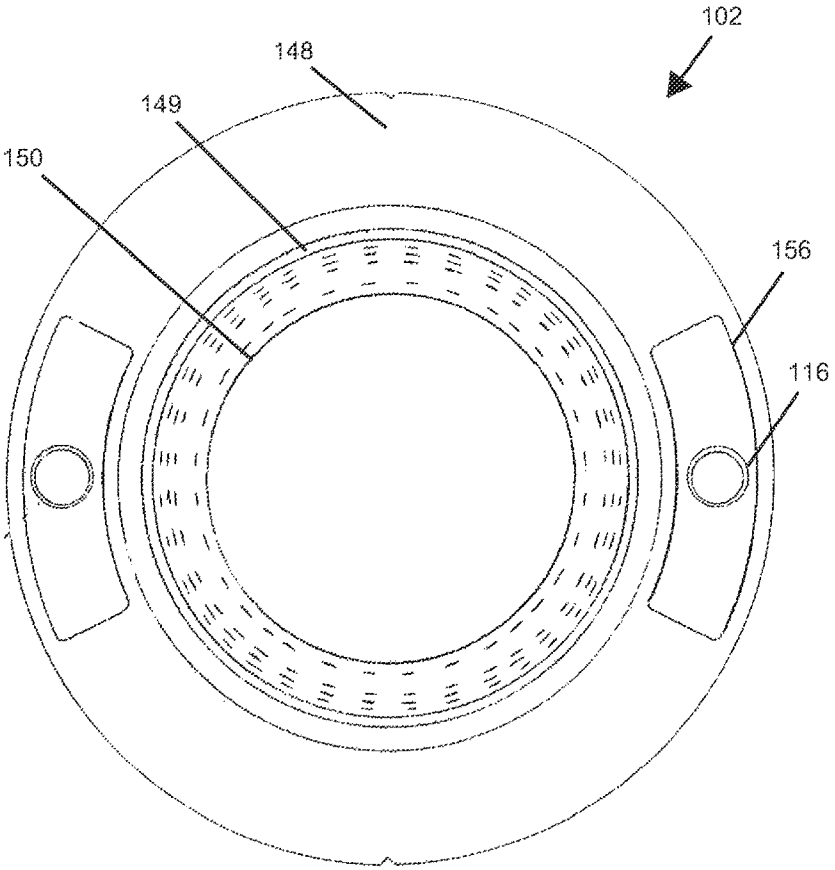
FIGS. 17A and 17B are top and bottom plan views of the male upper flange of the telescoping toilet mounting system of FIG. 14.
Figure 17A:
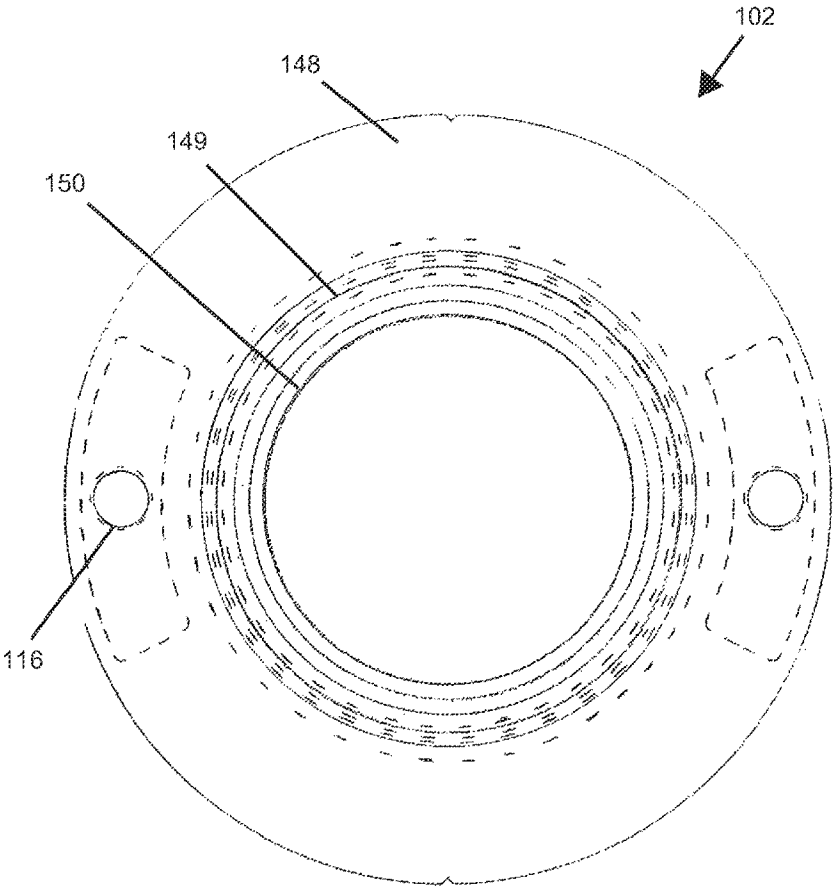

The upper male flange section 102 is shown apart from the remainder of the mounting system 100 in FIGS. 17A and 17B. There, one can perceive that the annular ring portion 148 of the upper male flange section 102 again has first and second arcuate furrows 156 disposed in opposition on the underside thereof. First and second apertures 116 are again disposed in opposition centrally within the first and second furrows 156.

A sealing O-ring 146 is retained by the female flange section 104, such as by being received in an annular channel in the inner surface of the tubular wall portion 154 of the lower flange section 104 or, as in the present embodiment, by being received in an annular channel in the outer surface of the tubular wall portion 150 of the upper flange section 102. In either case, when the telescopic toilet mounting system 100 is assembled, the O-ring 146 is sealingly disposed between the tubular wall portion 150 of the upper male flange section 102 and the tubular wall portion 154 of the lower female flange section 104.

Figure 15:
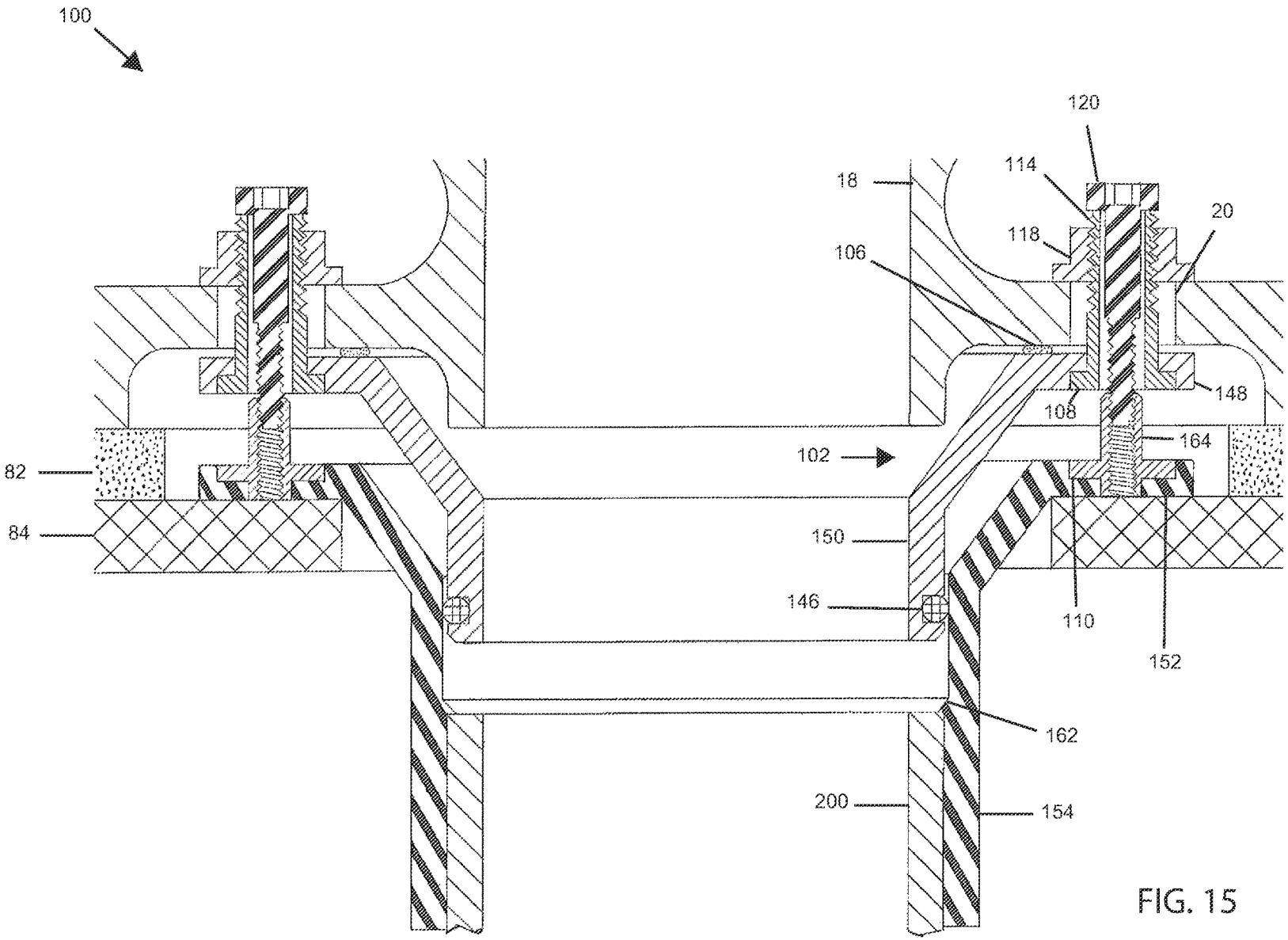
FIG. 15 is a cross-sectional view of the embodiment of the telescoping toilet mounting system of FIG. 14 positioned mounting a toilet in relation to a floor structure with a subfloor and additional flooring material applied thereto.
Figure 16:
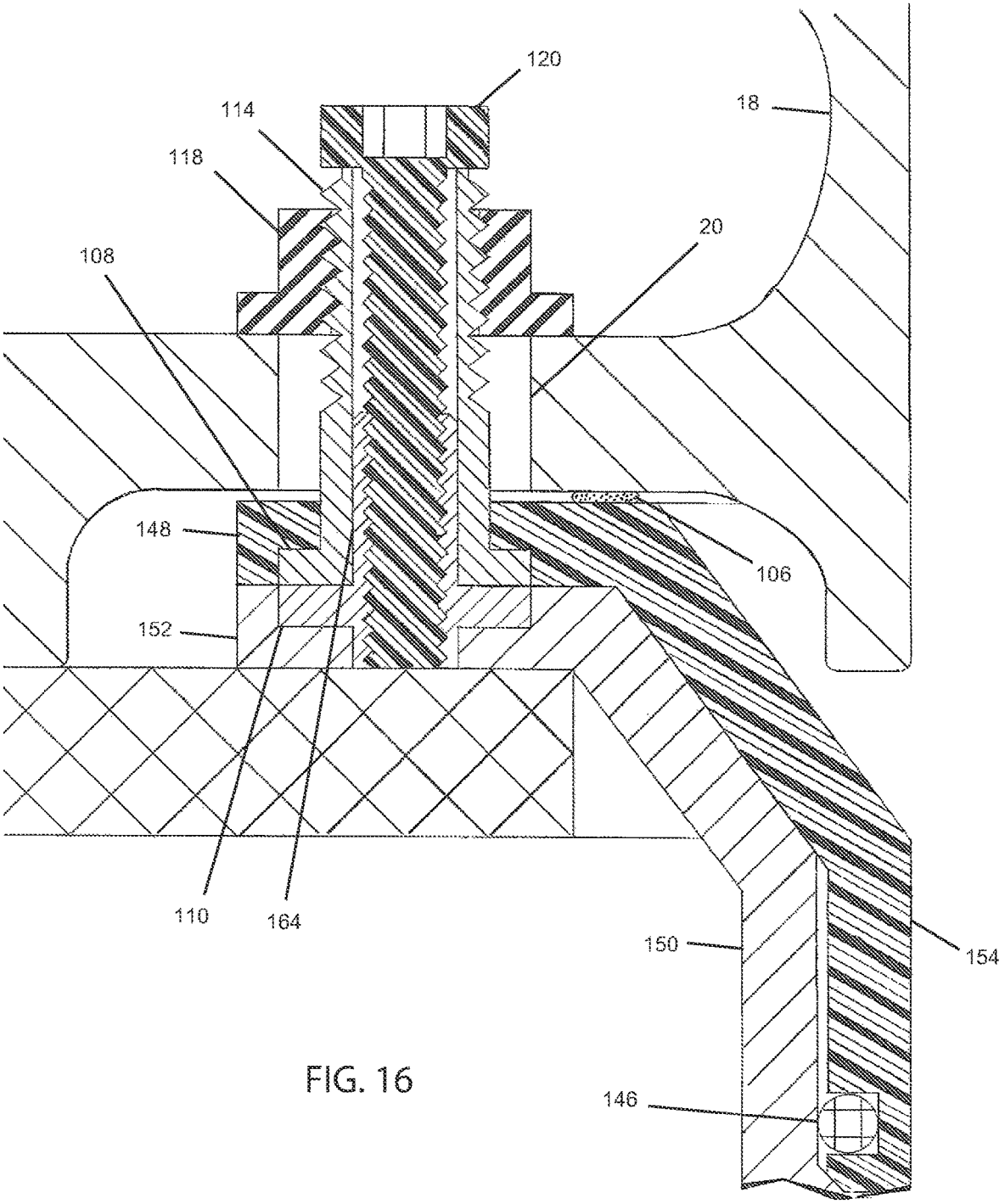
FIG. 16 is a cross-sectional view of the embodiment of the telescoping toilet mounting system of FIG. 14 positioned mounting a toilet in relation to a floor structure with a subfloor.

As shown in FIG. 14 and in the cross sectional views of FIGS. 15 and 16, the mounting system 100 further comprises first and second arcuate clamping plates 108 that are shaped and sized to be received into the arcuate furrows 156 in the underside of the upper male flange section 102. A hollow bolt 114 with a tubular interior is externally threaded and is fixed, such as by welding, integral formation, threaded engagement, or otherwise, to project from each clamping plate 108.

When the clamping plate 108 is inserted below the rim portion 148 of the upper male flange section 102, the hollow bolts 114 are received through the apertures 116 in the upper male flange section 102 ultimately to be received through the mounting holes 20 of the toilet base 18. Hold-down nuts 118 are threadedly engaged with the external threads of the hollow bolts 114 thereby fastening the upper male flange section 102 to the toilet base 18.

When the mounting system 100 is fully installed, an annular sealant ring 106 is disposed between the upper male flange section 102 and the toilet base 18 to be compressed upon tightening of the hold-down nuts 118. A watertight connection between the upper male flange section 102 and the toilet base 18 is thus established.

Figure 18B:
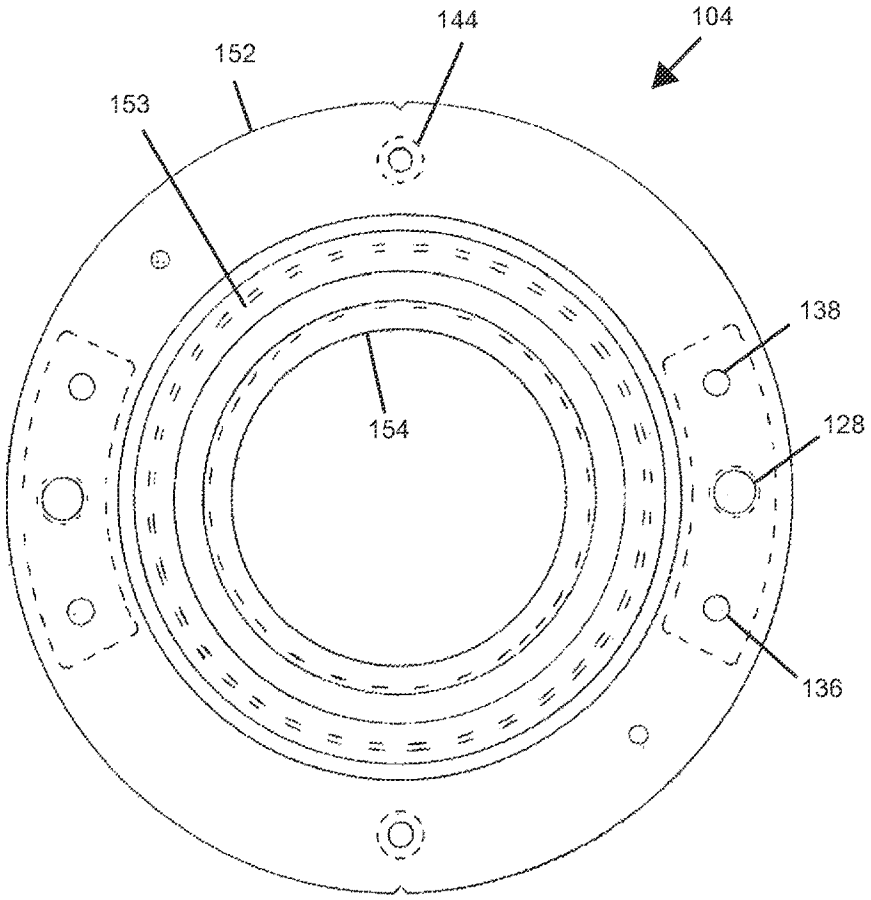
FIGS. 18A and 18B are top and bottom plan views of the female lower flange of the telescoping toilet mounting flange of FIG. 14.
Figure 18A:
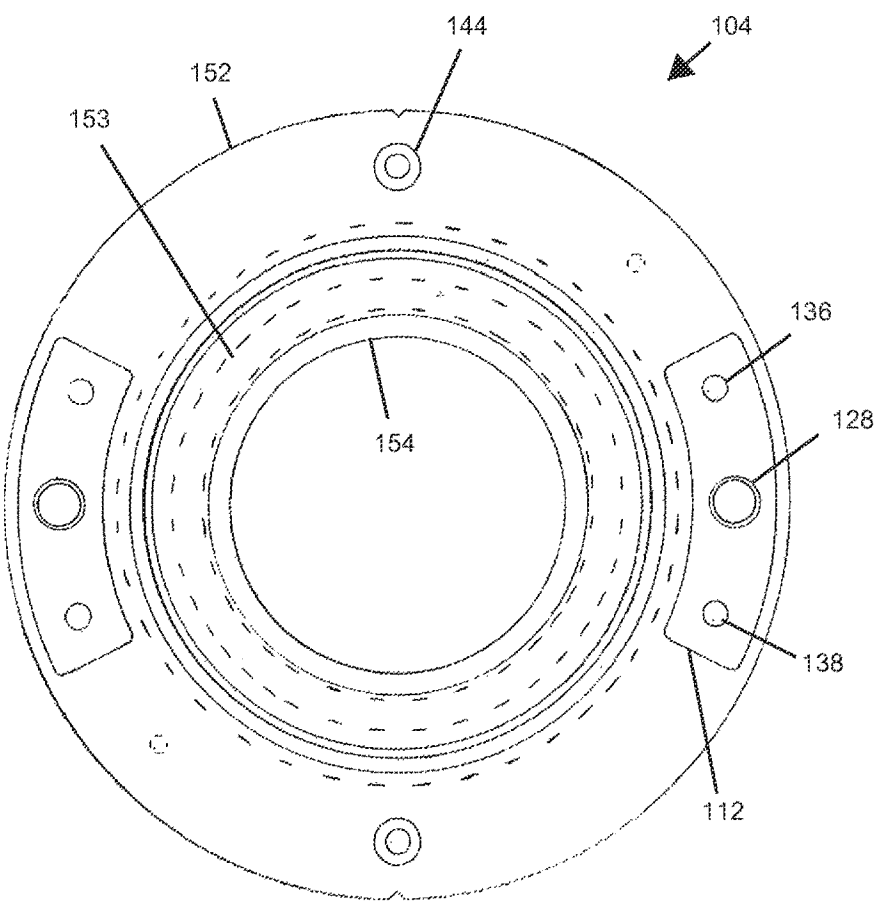

The lower female flange section 104, which is shown apart from the overall mounting system 100 in FIGS. 18A and 18B, again has first and second arcuate furrows 112 disposed in opposition within the upper surface thereof. The arcuate furrows 112 receive and retain correspondingly sized and shaped arcuate mounting plates 110. The locking plates 110 again have central apertures that pass therethrough. However, in the present embodiment, tubular, internally threaded registration and locking rods 164 are fixed to the mounting plates 110 concentric with the central apertures, such as by welding, integral formation, threaded engagement, or otherwise. As best seen in FIGS. 15 and 16, each registration and locking rod 164 has a lower projecting portion that extends beyond the mounting plate 110 by a distance approximately equal to the thickness of the annular ring portion 152 of the lower female flange section 104 within the arcuate furrow 112, and each registration and locking rod 164 has an upper projecting portion that projects a distance, such as but not limited to approximately ½ inch, upwardly from the mounting plate 110. The upper projecting portions of the registration and locking rods 164 thus act as upstanding registration pins for being received into the hollow bolts 114 that are retained in relation to the toilet base 18 by the upper male flange section 102.

The registration and locking rods 164 are disposed to align concentrically with centrally disposed apertures 128 that are disposed through the lower female flange section 104 within the first and second arcuate furrows 112. Furthermore, first and second mounting apertures 130 and 132 are disposed through each mounting plate 110 outboard of the registration and locking rod 164, and apertures 136 and 138 are disposed through the lower female flange section 104 within the first and second arcuate furrows 112 in alignment with the first and second mounting apertures 130 and 132 in the mounting plates 110.

In methods for installing the mounting system 100, fasteners 158 and 160 can be driven through the aligned apertures 130 and 136 and 132 and 138 and into flooring material 84 to secure the lower female flange section 104 in place. Where the flooring 84 and any additional flooring material 82 includes wood or another material into which one can screw directly, the fasteners 158 and 160 can comprise wood screws. In other installations, such as in relation to a room with a formed material, such as but not limited to concrete, the fasteners 158 and 160 can be threadedly received by internally threaded anchor bolts 140 and 142 (as previously shown, for instance, in FIG. 9) that can be preset in the floor material as discussed, for instance, in relation to the embodiment of FIGS. 5 and 6. Where necessary, additional fasteners can be driven through supplemental apertures 144 in the lower female flange section 104 and into the flooring materials 82 and 84.

Under this construction, an installer again can carry out an efficient and convenient method of mounting of a toilet in relation to a floor structure and a wastewater pipe 200 by fastening the upper male flange section 102 to a toilet base 18 and separately securing the lower female flange section 104 in relation to a floor structure. The toilet base 18 can rest atop an additional flooring material 82 disposed atop a base floor material 84 or directly on a base floor material 84. By engagement of the hold-down nuts 118 with the hollow bolts 114, the clamping plates 108 can be caused to clamp the upper male flange section 102 into fixed engagement with the toilet base 18 with the sealing O-ring 106 creating a liquid-tight relationship therebetween. The tubular wall portion 154 of the lower female flange section 104 is matingly or otherwise sealingly received into the wastewater pipe 200, and fasteners 158 and 160 are passed through the mounting plate 110 and are driven into the flooring materials 82 and/or 84. As previously shown and described, the fasteners 158 and 160 can, by way of example and not limitation, be directly screwed into the flooring material 82 and/or 84 or screwed into anchor bolts 140 and 142 that are embedded in the flooring material 82 and/or 84 thereby fixing the lower female flange structure 104 in place relative to the floor structure. As in FIG. 15, a sealing shoulder or O-ring 162 or another sealing mechanism or mechanisms ensures a liquid-tight relationship between the lower female flange structure 104 and the wastewater pipe 200.

With the upper male flange section 102 thus fixed to the toilet base 18 and the lower female flange section 104 fixed relative to the floor structure and the wastewater pipe 200, the toilet can be quickly and reliably engaged with the wastewater pipe 200 by lowering the upper male flange section 102 into mating engagement with the lower female flange section 104 with the sealing O-ring 146, which in the present embodiment is retained within an annular channel in the tubular wall portion 150 of the upper male flange section 102, establishing a liquid-tight relationship between the flange sections 102 and 104. As the upper male flange section 102 engages the lower female flange section 104, the upstanding registration and locking rods 164, which now fixedly project upwardly from the mounting plates 110, the lower female flange section 104, and the floor to which the lower female flange section 104 is fixed, can be readily aligned with and received into the hollow bolts 114 that are fixed to the toilet together with the upper male flange section 102. Since the lower female flange section 104 and the registration and locking rods 164 projecting therefrom are fixed in a known, predetermined orientation, the upper male flange section 102 and thus the toilet are accurately and efficiently aligned and then maintained in alignment.

With the upper and lower flange sections 102 and 104 and the toilet so engaged, the toilet can be fixed in place by application of threaded fastening bolts 120. To do so, the fastening bolts 120 are inserted from above through the hollow bolts 114 and into threaded engagement with the internally threaded registration and locking rods 164, which are fixed in place relative to the lower flange section 104 and in relation to the floor structure. The toilet can thus be efficiently mounted in a reliably watertight manner without the messiness of a wax ring and without the difficult and cumbersome alignment and fastening of toilet bolts required by the prior art.

By virtue of the lengths of the registration and locking rods 164, the mounting system 100 can accommodate varied flooring situations and thicknesses. For instance, as in FIG. 15 where the subfloor material 82 has additional flooring material 84 of a given thickness applied thereto, the fastening bolts 120 may extend into threaded engagement with the registration and locking rods 164 by a given amount to lock the toilet in place while accommodating the additional flooring material 84 and the consequent spacing between the ring portions 148 and 152 of the upper and lower flange sections 102 and 104. However, where no additional flooring material 84 is incorporated as in FIG. 16, the fastening bolts 120 may extend into threaded engagement with the registration and locking rods 164 by a greater amount to lock the toilet in place while the ring portions 148 and 152 of the upper and lower flange sections 102 and 104 are disposed in greater proximity or in direct contact.

The mounting system 100 so illustrated and described achieves plural advantages over the prior art and even over the mounting configurations previously disclosed herein. By their upstanding and elongate nature, the registration and locking rods 164 permit rapid and accurate alignment of the toilet as the hollow bolts 114 can be simply lowered onto the registration and locking rods 164. Indeed, the toilet with the upper male flange section 102 fixed thereto can be efficiently 'dropped' onto the registration and locking rods 164 in a rapid and precisely aligned manner. Moreover, due to the internal threads communicating along the elongate registration and locking rods 164, a greatly increased and strengthened threaded length is provided for engagement and retention of the fastening bolts 120 as compared, for instance, to simple threaded apertures in the mounting plates 110. Moreover, different thicknesses of flooring materials 82 and 84 can be readily accommodated.

In one non-limiting but illustrative embodiment, the registration and locking rods 164 can have upstanding lengths of approximately ½ inch extending above the mounting plate 110 and an additional ¼ inch length disposed within and extending below the mounting plate 110. With that, the threaded length provided for engaging the fastening bolts 120 is increased from the thickness of the mounting plate 110 in earlier embodiments to ¾ inch. This markedly increases the strength of the bolted connection between the upper and lower flange sections 102 and 104 and thus between the toilet and the floor structure. Still further, by their known disposition within the hollow bolts 114, the registration and locking rods 164 are readily engaged by the fastening bolts 120 with accuracy.

In the depicted embodiment, the securing of the upper flange section 102 to the lower flange section 104 and thus of the toilet to the floor structure is carried out by threaded fastening bolts 120. However, it would also be possible to use a fastening bolt structure 121 as previously shown and described with reference, for instance, to FIGS. 10 and 11. As previously shown and described, such fastening bolt structures 121 provide a body portion that is adjustable in length from the bolt head to the threaded tip 124. The fastening bolt structure 121 can thus comprise a barrel bolt formed by an internally threaded barrel sleeve 122 that terminates in the threaded tip 124 and a screw 120 that is threadedly received into the barrel sleeve 122. The effective length of the fastening bolt structure 121 can thus be adjusted by rotation of the screw 120 within the barrel sleeve 122 to fix the toilet base 18 in place.

In use, the mounting system 100 so disclosed meets the recognized and long-felt need for mounting a toilet base 18 to a wastewater pipe 200 in a watertight relationship in an efficient and accurately oriented manner without the mess of a wax ring and without the difficulties and frustration involved with traditional toilet bolts. By permitting a mounting of the upper male flange section 102 to the toilet base 18 in a permanent manner and a fastening of the joined toilet base 18 and upper male flange section 102 to the lower female flange section 104 and wastewater pipe 200 in a rapid and precisely aligned manner, the need of the prior art for lowering a heavy toilet precisely onto precariously upstanding bolts with multiple fasteners, messy wax rings, and potentially unsanitary leaks is eliminated.

With certain details and embodiments of the present invention for a telescoping toilet mounting system 100 and a method for mounting a toilet disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims shall define the scope of protection to be afforded to the inventors. Those claims shall be deemed to include equivalent constructions insofar as they do not depart from the spirit and scope of the invention. Certain claims may express, or be interpreted to express, certain elements as means for performing a specific function, at times without the recital of structure or material. As the law demands, any such claims shall be construed to cover not only the corresponding structure and material expressly described in this specification but also all legally-cognizable equivalents thereof.

What is claimed as deserving the protection of Letters Patent:

1. A telescoping toilet mounting assembly for connecting a toilet with a toilet base with first and second spaced mounting holes and a wastewater discharge port to a floor and a wastewater pipe, the toilet mounting assembly comprising:

a lower female flange section with a ring portion and a tubular wall portion;

an upper male flange section for being mounted concentric with the wastewater discharge port of the toilet base wherein the upper male flange section has a ring portion with first and second spaced mounting holes for aligning with the first and second mounting holes of the toilet base and a tubular wall portion for being received into the lower female flange section;

first and second hollow bolts for being respectively retained in concentric alignment with the first and second mounting holes of the upper male flange section and through the first and second mounting holes of the toilet base wherein the first and second hollow bolts have exterior threads and broadened head portions;

first and second base bolt nuts for being tightened onto the exterior threads of the first and second hollow bolts respectively;

first and second registration and locking rods for being retained to project from the ring portion of the lower female flange section wherein the registration and locking rods are tubular and internally threaded;

first and second fastening bolts, each fastening bolt with a bolt head and a threaded portion, for being respectively received through the first and second hollow bolts and into threaded engagement with the first and second registration and locking rods;

whereby the upper male flange section can be attached to the toilet base by passing the first and second hollow bolts through the first and second mounting holes of the toilet base and tightening the first and second base bolt nuts onto the first and second hollow bolts, whereby the lower female flange section can be attached to a floor structure with the tubular wall portion of the lower female flange section received into the wastewater pipe and with the first and second registration and locking rods retained to project from the ring portion of the lower female flange section, and whereby the toilet base and the upper male flange section can be attached to the lower female flange section and thus to the wastewater pipe by aligning the first and second hollow bolts with the first and second registration and locking rods and causing the first and second locking rods to be received into the first and second hollow bolts and by passing the first and second fastening bolts through the first and second hollow bolts and into threaded engagement with the first and second registration and locking rods.

2. The telescoping toilet mounting assembly of claim 1, wherein the broadened head portion of each of the first and second hollow bolts comprises a clamping plate wherein the hollow bolt is fixed to project from the clamping plate.

3. The telescoping toilet mounting assembly of claim 2, wherein each clamping plate comprises an arcuate clamping plate.

4. The telescoping toilet mounting assembly of claim 3, further comprising arcuate furrows in an underside of the ring of the upper male flange section for receiving the clamping plates.

5. The telescoping toilet mounting assembly of claim 1, further comprising an annular sealant ring for being disposed between the upper male flange section and the toilet base to establish a watertight connection therebetween.

6. The telescoping toilet mounting assembly of claim 5, further comprising a sealant ring for being interposed between the tubular wall portions of the upper male flange section and the lower female flange section.

7. The telescoping toilet mounting assembly of claim 1, wherein each registration and locking rod is retained relative to the lower female flange section by a mounting member.

8. The telescoping toilet mounting assembly of claim 7, wherein each mounting member comprises a mounting plate.

9. The telescoping toilet mounting assembly of claim 8, further comprising arcuate furrows in the ring portion of the lower female flange section wherein each mounting plate comprises an arcuate mounting plate for being received in one of the arcuate furrows in the ring portion of the lower female flange section.

10. The telescoping toilet mounting assembly of claim 9, further comprising first and second mounting apertures disposed through each mounting plate spaced from the registration and locking rod.

11. The telescoping toilet mounting assembly of claim 10, further comprising mounting fasteners for passing through the mounting apertures in the mounting plates, through the lower female flange section, and into a flooring material.

12. The telescoping toilet mounting assembly of claim 7, wherein each registration and locking rod has a lower projecting portion that extends downwardly beyond the mounting member by a distance and wherein each registration and locking rod has an upper projecting portion that projects upwardly from the mounting member by a distance whereby the upper projecting portions of the registration and locking rods act as upstanding registration pins for engaging and being received into the hollow bolts.

13. The telescoping toilet mounting assembly of claim 12, wherein the lower projecting portions of the registration and locking rods are received into and line apertures in the lower female flange section.

14. A telescoping toilet mounting assembly for connecting a toilet with a toilet base with first and second spaced mounting holes and a wastewater discharge port to a floor and a wastewater pipe, the toilet mounting assembly comprising:

a lower female flange section with a ring portion and a tubular wall portion;

an upper male flange section for being mounted concentric with the wastewater discharge port of the toilet base wherein the upper male flange section has a ring portion with first and second spaced mounting holes for aligning with the first and second mounting holes of the toilet base and a tubular wall portion to be received into the lower female flange section;

first and second hollow bolts for being respectively retained in concentric alignment with the first and second mounting holes of the upper male flange section and through the first and second mounting holes of the toilet base wherein the first and second hollow bolts have exterior threads and broadened head portions comprising clamping members;

first and second base bolt nuts for being tightened onto the exterior threads of the first and second hollow bolts respectively;

first and second registration and locking rods for being retained to project from the ring portion of the lower female flange section wherein the registration and locking rods are tubular and internally threaded and wherein each of the first and second registration and locking rods is retained by a mounting member;

first and second fastening bolts, each fastening bolt with a bolt head and a threaded portion for being respectively received through the first and second hollow bolts and into threaded engagement with the first and second registration and locking rods;

whereby the upper male flange section can be attached to the toilet base by passing the first and second hollow bolts through the first and second mounting holes of the toilet base and tightening the first and second base bolt nuts onto the first and second hollow bolts, whereby the lower female flange section can be attached to a floor structure with the tubular wall portion of the lower female flange section received into the wastewater pipe and with the first and second registration and locking rods retained to project from the ring portion of the lower female flange section, and whereby the toilet base and the upper male flange section can be attached to the lower female flange section and the wastewater pipe by aligning the first and second hollow bolts with the first and second registration and locking rods and causing the first and second locking rods to be received into the first and second hollow bolts and by passing the first and second fastening bolts through the first and second hollow bolts and into threaded engagement with the first and second registration and locking rods.

15. The telescoping toilet mounting assembly of claim 14, wherein the clamping member comprises a clamping plate wherein the hollow bolt is fixed to project from the clamping plate.

16. The telescoping toilet mounting assembly of claim 15, further comprising furrows in an underside of the ring of the upper male flange section for receiving the clamping plates.

17. The telescoping toilet mounting assembly of claim 14, wherein each mounting member comprises a mounting plate.

18. The telescoping toilet mounting assembly of claim 17, further comprising furrows in the ring portion of the lower female flange section for receiving the mounting plates.

19. The telescoping toilet mounting assembly of claim 17, further comprising first and second mounting apertures disposed through the mounting member spaced from the registration and locking rod.

20. The telescoping toilet mounting assembly of claim 19, further comprising mounting fasteners for passing through the mounting apertures in the mounting members, through the lower female flange section, and into a flooring material.

21. The telescoping toilet mounting assembly of claim 14, wherein each registration and locking rod has a lower projecting portion that extends downwardly beyond the mounting member by a distance and wherein each registration and locking rod has an upper projecting portion that projects upwardly from the mounting member by a distance whereby the upper projecting portions of the registration and locking rods act as upstanding registration pins for engaging and being received into the hollow bolts.

22. The telescoping toilet mounting assembly of claim 21, wherein the lower projecting portions of the registration and locking rods are received into and line apertures in the lower female flange section.

23. A method for mounting a toilet with a toilet base with first and second spaced mounting holes and a wastewater discharge port to a floor and a wastewater pipe, the toilet mounting method comprising:

providing a telescoping toilet mounting assembly that comprises:

a lower female flange section with a ring portion and a tubular wall portion;

an upper male flange section for being mounted concentric with the wastewater discharge port of the toilet base wherein the upper male flange section has a ring portion with first and second spaced mounting holes for aligning with the first and second mounting holes of the toilet base and a tubular wall portion to be received into the lower female flange section;

first and second hollow bolts for being respectively retained in concentric alignment with the first and second mounting holes of the upper male flange section and through the first and second mounting holes of the toilet base wherein the first and second hollow bolts have exterior threads and broadened head portions;

first and second base bolt nuts for being tightened onto the exterior threads of the first and second hollow bolts respectively;

first and second registration and locking rods for being retained to project from the ring portion of the lower female flange section wherein the registration and locking rods are tubular and internally threaded;

first and second fastening bolts, each fastening bolt with a bolt head and a threaded portion for being respectively received through the first and second hollow bolts and into threaded engagement with the first and second registration and locking rods;

attaching the upper male flange section to the toilet base by passing the first and second hollow bolts through the first and second mounting holes of the toilet base and tightening the first and second base bolt nuts onto the first and second hollow bolts;

mounting the lower female flange section concentrically with the wastewater pipe with the first and second registration and locking rods retained to project upwardly from the lower female flange section;

attaching the toilet base and the upper male flange section to the lower female flange section and the wastewater pipe by aligning the first and second hollow bolts with the first and second registration and locking rods and causing the first and second locking rods to be received into the first and second hollow bolts and by passing the first and second fastening bolts through the first and second hollow bolts and into threaded engagement with the first and second registration and locking rods.

24. The method of claim 23, wherein each of the first and second registration and locking rods is retained by a mounting member and wherein each mounting member further has at least one mounting aperture disposed through the mounting member spaced from the registration and locking rod and wherein the step of mounting the lower female flange section concentrically with the wastewater pipe comprises passing mounting fasteners through the mounting apertures in the mounting members and the lower female flange section and into a flooring material.

25. The method of claim 23, wherein the broadened head portions of the first and second hollow bolts comprise clamping members and wherein the first and second hollow bolts are fixed to project from the clamping members.

26. The method of claim 23, wherein each of the first and second registration and locking rods is retained by a mounting member.

27. The method of claim 26, further comprising first and second mounting apertures disposed through each mounting member spaced from the registration and locking rod and wherein the step of mounting the lower female flange section concentrically with the wastewater pipe comprises passing mounting fasteners through the mounting apertures in the mounting members, through the lower female flange section, and into a flooring material.

* * * * *